US006653059B2

(12) United States Patent
Seki

(10) Patent No.: US 6,653,059 B2
(45) Date of Patent: Nov. 25, 2003

(54) LIQUID PROCESSING COMPOSITION FOR COLOR DEVELOPMENT OF SILVER HALIDE COLOR PHOTOGRAPHIC MATERIAL AND DEVELOPMENT PROCESSING METHOD

(75) Inventor: Hiroyuki Seki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/225,495

(22) Filed: Aug. 22, 2002

(65) Prior Publication Data

US 2003/0148230 A1 Aug. 7, 2003

(30) Foreign Application Priority Data

Aug. 23, 2001 (JP) ..... P. 2001-253094

(51) Int. Cl.[7] ..... G03C 7/413
(52) U.S. Cl. ..... 430/486; 430/493; 430/933
(58) Field of Search ..... 430/486, 493, 430/933

(56) References Cited

U.S. PATENT DOCUMENTS 6,004,739 A * 12/1999 Ikesu et al. ..... 430/557

FOREIGN PATENT DOCUMENTS

JP 2001-166440 6/2001

* cited by examiner

*Primary Examiner*—Hoa Van Le
(74) *Attorney, Agent, or Firm*—Burns, Doane, Swecker & Mathis, LLP

(57) ABSTRACT

The present invention is a liquid processing composition for a color development of a silver halide color photographic material, which comprises: at least one specific compound; at least one glycol selected from the group consisting of ethylene glycol, diethylene glycol and triethylene glycol; and at least one polyethylene glycol having a number average molecular weight of from 1,000 to 2,000, and a development processing method using the same.

16 Claims, No Drawings

LIQUID PROCESSING COMPOSITION FOR COLOR DEVELOPMENT OF SILVER HALIDE COLOR PHOTOGRAPHIC MATERIAL AND DEVELOPMENT PROCESSING METHOD

FIELD OF THE INVENTION

The present invention relates to a color development processing composition for use in processing of a silver halide color photographic material and a development processing method using the same, more specifically, relates to a color development processing composition capable of obtaining good color balance even when color developing time is shortened, heaving practicably sufficient solubility even when the processing composition is the state of liquid, and not generating coloring of the container, and also relates to a development processing method using the same.

BACKGROUND OF THE INVENTION

In recent years, with the spread of a small-sized service system of processing in a store called a mini-lab, shortening of the required time of development processing of a silver halide photographic material (hereinafter it is also called "a photographic material" for the sake of simplicity) is strongly demanded for rapidly responding to the demand of processing of customers As the means of shortening color developing speed, increasing the pH of a developing solution and processing temperature has been tried, but photographic performances are subject to heavy fluctuations by continuous processing and the stability of a developing solution is also deteriorated, therefore, these means are practicably limitative.

Speedup of processing by high activation of a color developing solution has so far been variously discussed, e.g., by high concentration of a color developing agent as disclosed in JP-A-4-67038 (the term "JP-A" as used herein means an "unexamined published Japanese patent application") and increasing of processing temperature as disclosed in JP-A-4-81848.

However, since a color developing agent and an alkali agent percolate, react and consume from the uppermost layer of a photographic material in a color development processing step, the arrival of the active ingredients of a developing agent and an alkali agent at the lowermost layer is delayed. In particular, when rapid processing is performed, since a developing agent is not supplied to the lowermost layer sufficiently, the improvement of the developing velocity of the lowermost layer is an especially important problem to be solved for advancing rapid processing. When developing time is shortened for the purpose of accelerating color developing velocity, percolation and supply of a developing agent are in general limited, and the development of the layer nearer to the support (the lower layer) is delayed as compared with the development of the layer farther from the support (the upper layer), as a result, color balance is lost and color reproduction comes to worsen conspicuously.

As a means to make it possible to realize rapid processing without being accompanied by the disorder of color balance and the worsening of color reproduction due to high temperature and high activation, JP-A-2001-166440 proposes to use a composition of color development processing agent containing at least one of polyethylene glycols, polyvinyl pyrrolidones or thioureas with alkylsulfonate. Although this is an effective means to solve the above problem, when high activation step is carried out, such that a development accelerating compound is added, a developing agent is highly concentrated, or the pH value of a developing solution is made high, a developer composition is generally adsorbed onto the container of the developer composition and the container is colored, in particular, under high temperature and high humidity conditions (a heat humidity condition), thus product life is generally impaired. The coloring of containers is also actualized in the above proposals. Further, there are cases where the constitutional members of an automatic processor are also colored by such a composition of processing agent. Accordingly, this method cannot be a sufficient means to solve the above problem in a practicable point.

As another problem, when a color developing solution contains a diaminostilbene derivative for the purpose of prevention of contamination of a photographic material, hindrance, such as the formation of dissolved product and the generation of turbidity, is liable to occur during storage, since the solubility is not sufficient. In particular, when a color developer composition is a liquid mixed processing agent, high concentration is largely restricted by solubility, therefore, constitution of composition capable of high concentration has been demanded.

SUMMARY OF THE INVENTION

The present invention has been performed on the basis of the above background for the purpose of providing a liquid development processing agent which is satisfied in all of the resistance to the coloring of the container of a processing agent composition, solubility and rapid development property, and providing a development processing method using the development processing agent. Specifically, the objects of the present invention is to provide a composition of liquid development processing composition which (i) has sufficient solubility not to generate turbidity and precipitation during storage of the processing composition, (ii) hardly generates the coloring of the container of the processing composition during storage even when the processing composition is a highly concentrated liquid, and (iii) has rapid development aptitude capable of obtaining good color balance even when developing time is shortened by increasing the developing temperature, increasing the activity of the processing agent, and increasing the concentration of the processing agent, and to provide a development processing method using the same composition.

The present inventors have found that the above problems can be solved by a development processing solution containing bis (triazinylamino)stilbene of specific structure having at least 4 sulfonic acid groups in the molecule together with ethylene glycols of a specific combination, and, on the basis of this fact, the present invention described in the followings.

(1) A liquid processing composition for a color development of a silver halide color photographic material, which comprises:

- at least one compound represented by the following formula (I);
- at least one glycol selected from the group consisting of ethylene glycol, diethylene glycol and triethylene glycol; and
- at least one polyethylene glycol having a number average molecular weight of from 1,000 to 2,000:

(I)

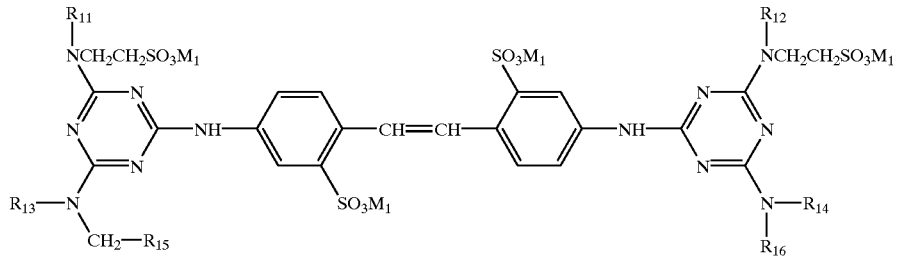

wherein $R_{11}$ and $R_{12}$ each independently represents a hydrogen atom or an alkyl group; $R_{13}$ and $R_{14}$ each independently represents a hydrogen atom, an alkyl group or an aryl group; $R_{15}$ represents an alkyl group having at least one asymmetric carbon atom, or a group represented by the following formula (I-a); $R_{16}$ represents an alkyl group having at least one asymmetric carbon atom, or a group represented by the following formula (I-b); and $M_1$ represents a hydrogen atom, an alkali metal atom, an alkaline earth metal atom, an ammonium group or a pyridinium group; $R_{13}$ and $R_{15}$, and $R_{14}$ and $R_{16}$ may be bonded to each other to form a ring;

$$—CH_2O(CH_2CH_2O)_{n_{11}}H \quad \text{(I-a)}$$

wherein $n_{11}$ represents an integer of from 1 to 3;

$$—(CH_2CH_2O)_{n_{12}}H \quad \text{(I-b)}$$

wherein $n_{12}$ represents an integer of from 2 to 4.

(2) The liquid processing composition for a color development of a silver halide color photographic material as described in the item (1), wherein in formula (I), at least one of $R_{15}$ and $R_{16}$ includes a hydroxyl group.

(3) The liquid processing composition for a color development of a silver halide color photographic material as described in the item (1), wherein in formula (I), $R_{11}$, $R_{12}$, $R_{13}$ and $R_{14}$ each independently represents a hydrogen atom or a methyl group, $R_{15}$ is a group represented by formula 2), 5) or 11) below, or a group represented by formula (I-a) wherein $n_{11}$ is 1, $R_{16}$ is a group represented by formula 17), 20) or 26) below, or a group represented by formula (I-b) wherein $n_{12}$ is 2, $M_1$ is Na or K:

2)

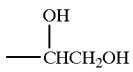

5)

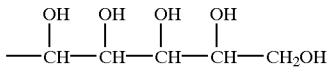

11)

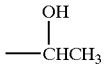

17)

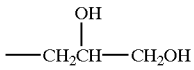

-continued

20)

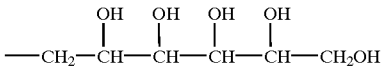

26)

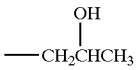

(4) The liquid processing composition for a color development of a silver halide color photographic material as described in the item (1), wherein the at least one glycol is selected from the group consisting of diethylene glycol and triethylene glycol.

(5) The liquid processing composition for a color development of a silver halide color photographic material as described in the item (1), which comprises the compound represented by the formula (I) in an amount of from 1 to 50 g/liter of the amount of the composition.

(6) The liquid processing composition for a color development of a silver halide color photographic material as described in the item (1), which comprises the glycol in an amount of from 5 to 100 g/liter of the amount of the composition.

(7) The liquid processing composition for a color development of a silver halide color photographic material as described in the item (1), which comprises the polyethylene glycol in an amount of from 1 to 20 g/liter of the amount of the composition.

(8) The liquid processing composition for a color development of a silver halide color photographic material as described in the item (1), which comprises 4-amino-3-methyl-N-ethyl-N-(β-hydroxyethyl)aniline or a salt thereof as a color developing agent in an amount of from 15 to 50 g/liter of the amount of the composition.

(9) A method for processing a silver halide color photographic material, which comprises performing a color development processing within 2 minutes and 30 seconds with the liquid processing composition for a color development as described in the item (1), wherein the liquid processing composition for a color development is used as it is or by being diluted, as a color developing replenisher or a color developer.

(10) The method for processing a silver halide color photographic material as described in the item (9), wherein the liquid processing composition for a color development has a concentration of from 1.5 to 10 times as high as that of the solution in working state.

(11) The method for processing a silver halide color photographic material as described in the item (9), wherein the silver halide color photographic material is a color photographic material for photographing.

(12) The method for processing a silver halide color photographic material as described in the item (9), wherein the color photographic material for photographing is a color negative photographic material for photographing.

(13) A method for processing a silver halide color photographic material, which comprises performing a color development processing at processing temperature of 40° C. or higher with the liquid processing composition for a color development as described in the item (1), wherein the liquid processing composition for a color development is used as it is or by being diluted, as a color developing replenisher or a color developer.

(14) The method for processing a silver halide color photographic material as described in the item (13), wherein the liquid processing composition for a color development has a concentration of from 1.5 to 10 times as high as that of the solution in working state.

(15) The method for processing a silver halide color photographic material as described in the item (13), wherein the silver halide color photographic material is a color photographic material for photographing.

(16) The method for processing a silver halide color photographic material as described in the item (13), wherein the color photographic material for photographing is a color negative photographic material for photographing.

The color development processing composition for a color photographic material according to the present invention contains bis(triazinylamino)stilbene of specific structure having at least 4 sulfonic acid groups in the molecule represented by formula (I), at least one glycol selected fromethyleneglycol, diethyleneglycolandtriethyleneglycol, and at least one polyethylene glycol (having a number average molecular weight of from 1,000 to 2,000), in combination with a color developing agent. By this constitution of the color development processing composition, the object of the present invention, i.e., a liquid development processing composition having all of sufficient solubility and sufficient aging stability not to generate turbidity and precipitation during storage, a sufficient preventing property of the coloring of a container, and rapid development aptitude can be obtained.

Since the liquid development processing composition according to the present invention and the development processing method using the same for color development can attain the slow-down of development progress of an emulsion layer nearer to a support due to the shortening of processing time, the reduction of image quality, such as disorder of color balance, is not caused. Thus, the composition and the development processing method using the same are especially advantageous to rapid and/or high temperature color development processing: within 2 minutes and 30 seconds and/or processing temperature of 40° C. or higher.

"The liquid processing composition for color development" in the present invention includes all the compositions for preparation of a color developing solution, for preparation of are plenisher for maintaining the properties of the color developing solution by replenishment, and for direct supply of the constitutional components to a developing tank and a replenishing tank, and they are liquid compositions comprising respective constitutional processing agents.

As described above, "the liquid processing agent in high concentration" and "the liquid color development in high concentration" in the present invention mean the liquid processing agents in high concentration suitable to be filled in a container as highly concentrated liquids having dissolved therein processing chemicals in high concentration, when supplied to processing laboratories, and they are distinguished from so-called solid processing agents. The liquid color development composition in high concentration in the present invention is generally used as a processing solution by being diluted with water and the like in prescribed concentration at a processing laboratory and used as a processing solution. The composition may be added to a processing tank after being diluted, or may be added to a processing tank separately from dilution water and used as a processing solution.

DETAILED DESCRIPTION OF THE INVENTION

The present invention is described below in further detail.

In the first place, formula (I) is described in detail.

The alkyl group represented by $R_{11}$ and $R_{12}$ is a substituted or unsubstituted alkyl group preferably having from 1 to 20, more preferably from 1 to 8, and particularly preferably from 1 to 4, carbon atoms. The examples of the substituents include a hydroxyl group, an alkoxyl group (e.g., methoxy, ethoxy), a sulfonic acid group, and an ethylene oxy group, and these groups may further be substituted with the above substituents. The specific examples of the alkyl groups represented by $R_{11}$ and $R_{12}$ include, e.g., a methyl group, an ethyl group, an n-propyl group, an i-propyl group, an n-octyl group, a 2-hydroxyethyl group, a 3-hydroxypropyl group, a 2-hydroxypropyl group, a 2-sulfoethyl group, a 2-methoxyethyl group, a 2-(2-hydroxyethoxy)ethyl group, a 2-[2-(2-hydroxyethoxy) ethoxy]ethyl group, and a 2-(2-[2-(2-hydroxyethoxy) ethoxy]ethoxylethyl group. $R_{11}$ and $R_{12}$ each preferably represents a hydrogen atom, a methyl group, an ethyl group, an n-propyl group, an n-butyl group, and a 2-sulfoethyl group, more preferably a hydrogen atom, a methyl group, an ethyl group, and a 2-sulfoethyl group, and particularly preferably a hydrogen atom and a methyl group.

The preferred carbon atom numbers, substituents and specific examples of the alkyl groups represented by $R_{13}$ and $R_{14}$ are the same as those described in $R_{11}$ and $R_{12}$. The aryl group represented by $R_{13}$ and $R_{14}$ is a substituted or unsubstituted aryl group preferably having from 6 to 20, more preferably from 6 to 10, and particularly preferably from 6 to 8, carbon atoms. The examples of the substituents include a hydroxyl group, an alkoxyl group (e.g., methoxy, ethoxy), a carboxyl group, an alkyl group (e.g., methyl, ethyl, propyl), a sulfonic acid group, an amino group, and a carbamoyl group, and these groups may further be substituted with the above substituents. The specific examples of the aryl groups represented by $R_{13}$ and $R_{14}$ include, e.g., a phenyl group, a naphthyl group, a 3,5-dicarboxyphenyl group, a 4-methoxyphenyl groups and a 3-isopropylphenyl group. $R_{13}$ and $R_{14}$ each preferably represents a hydrogen atom, a methyl group, an ethyl group, an n-propyl group, a 2-hydroxyethyl group, a 3-hydroxypropyl group, a 2-hydroxypropyl group, a 2-sulfoethyl group, a 2-(2-hydroxyethoxy)ethyl group, or a 2-[2-(2-hydroxyethoxy) ethoxyl]ethyl group, more preferably a hydrogen atom, a methyl group, an ethyl group, a 2-hydroxyethyl group, a 2-hydroxypropyl group, or a 2-(2-hydroxyethoxy) ethyl group, and particularly a hydrogen atom or a methyl group.

The alkyl group having at least one asymmetric carbon atom represented by $R_{15}$ is an alkyl group having preferably from 1 to 20, more preferably from 1 to 8, and particularly preferably from 1 to 4, carbon atoms, and may be a straight chain, branched or cyclic alkyl group. The examples of the substituents include a hydroxyl group, an amino group and a carboxyl group, and a hydroxyl group is preferred. The specific examples of the alkyl groups having at least one asymmetric carbon atom represented by $R_{15}$ include, e.g., the alkyl groups represented by the following formulae:

1)

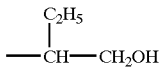

2)

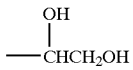

3)

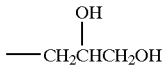

4)

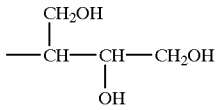

5)

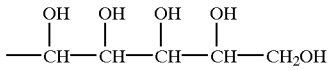

6)

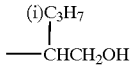

7)

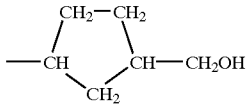

8)

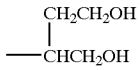

9)

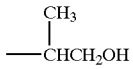

10)

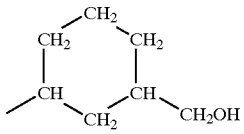

11)

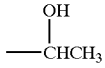

12)

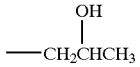

13)

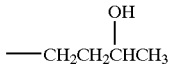

-continued

14)

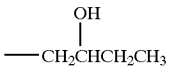

15)

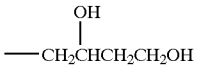

Of the alkyl groups having at least one asymmetric carbon atom represented by the above formulae, the alkyl groups represented by formulae 2), 3), 5), 8), 9) and 11) are preferred, and those represented by formulae 2), 5) and 11) are more preferred. Further, when $R_{15}$ is a group represented by the following formula (I-a), $n_{11}$ preferably represents 1 or 2, and more preferably 1.

$$—CH_2O(CH_2CH_2O)_{n_{11}}H \qquad \text{(I-a)}$$

The alkyl group having at least one asymmetric carbon atom represented by $R_{16}$ is an alkyl group having preferably from 1 to 20, more preferably from 1 to 9, and particularly preferably from 1 to 5, carbon atoms, and may be a straight chain, branched or cyclic alkyl group. The examples of the substituents include the same groups as described in $R_{15}$ a hydroxyl group, an amino group and a carboxyl group, and a hydroxyl group is preferred. The specific examples of the alkyl groups having at least one asymmetric carbon atom represented by $R_{16}$ include, e.g., the alkyl groups represented by the following formulae;

16)

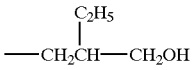

17)

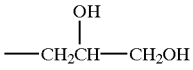

18)

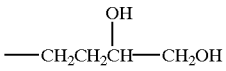

19)

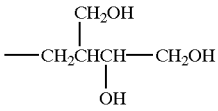

20)

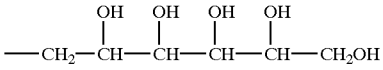

21)

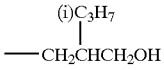

22)

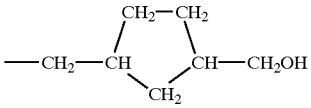

-continued

23)

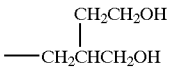

24)

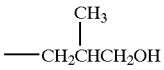

25)

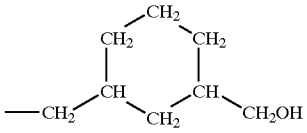

26)

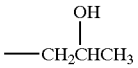

27)

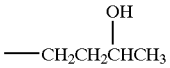

28)

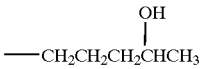

29)

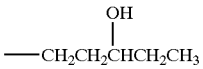

30)

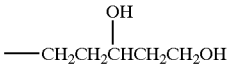

Of the alkyl groups having at least one asymmetric carbon atom represented by the above formulae, the alkyl groups represented by formulae 17), 18), 20), 23), 24) and 26) are preferred, and those represented by formulae 17), 20) and 26) are more preferred. Further, when $R_{16}$ is a group represented by the following formula (I-b), $n_{12}$ preferably represents 2 or 3, and more preferably 2.

$$—(CH_2CH_2O)_{n_{12}}H \qquad \text{(I-b)}$$

Of the alkali metal atoms and the alkaline earth metal atoms represented by $M_1$, Na and K are particularly preferred As the ammonium group represented by $M_1$, a tetraalkylammonium group is preferred, e.g., tetraethylammonium and tetrabutylammonium are exemplified. $M_1$ most preferably represents Na or K.

Of the compounds represented by formula (I), compounds wherein any one or both of $R_{15}$ and $R_{16}$ has (have) at least one hydroxyl group are preferred.

Of the compounds represented by formula (I), the most preferred compounds are compounds wherein $R_{11}$, $R_{12}$, $R_{13}$ and $R_{14}$ each represents a hydrogen atom or a methyl group, $R_{15}$ is an alkyl group represented by formula 2), 5) or 11), or $R_{15}$ is a group represented by formula (I-a) wherein $n_{11}$ is 1, $R_{16}$ is an alkyl group represented by formula 17), 20) or 26), or $R_{16}$ is a group represented by formula (I-b) wherein $n_{12}$ is 2, and $M_1$ is Na or K.

Since the compound for use in the present invention has a plurality of asymmetric carbon atoms in the molecule, a plurality of stereoisomers are present in the same structure. Possible all the stereoisomers are included in the present invention, and only one of a plurality of stereoisomers may be used or several kinds may be used as mixture.

A plurality of diaminostilbene-based compounds can be used in combination with the compound represented by formula (I) in the present invention, and the diaminostilbene compound represented by formula (III) in JP-A-6-329936 is preferred as the compound to be used in combination.

Well-known or commercially available diaminostilbene-based fluorescent brightening agents may be used in the present invention as the diaminostilbene-based compound usable in combination. Commercially available compounds are described, e.g., in *Senshoku Note* (*Coloring Note*), 19th Ed., pp. 165 to 168, Senshoku-Sha Co. Of the products described ibidem, Blankophor BSU liq (a trade name) and Hakkol BRK (a trade name) are preferably used.

The representative specific examples of the compounds represented by formula (I) which can be used in the present invention are shown below. In these formulae, Me represents a methyl group and Et represents an ethyl group.

I-1)

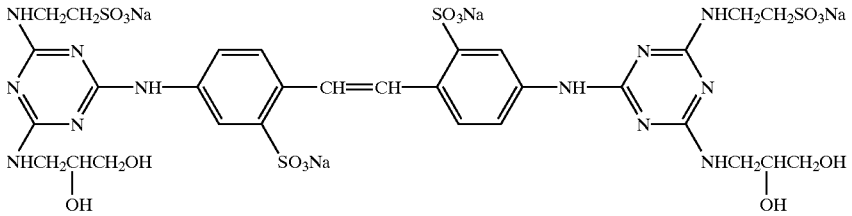

I-2)

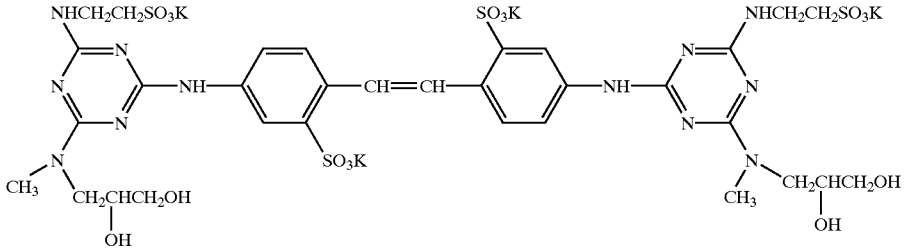

-continued
I-3)
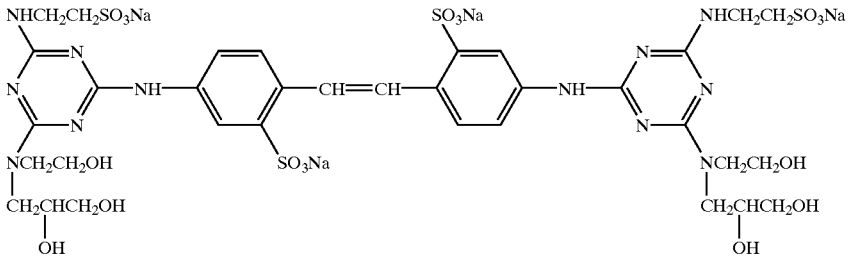
I-4)
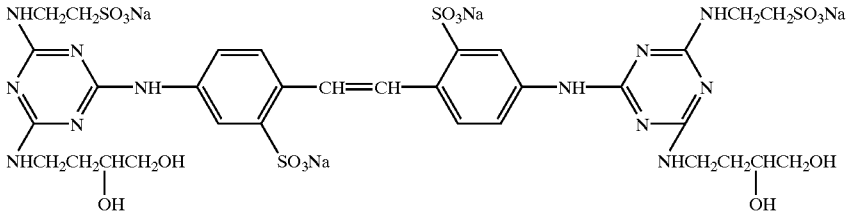
I-5)
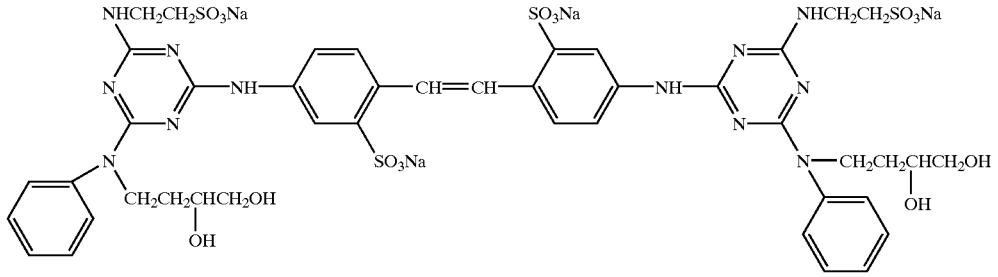
I-6)
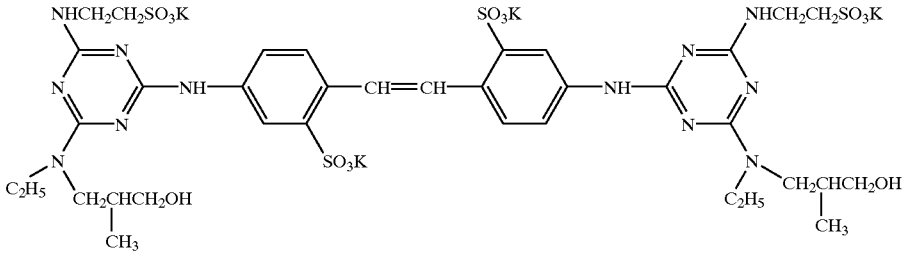
I-7)
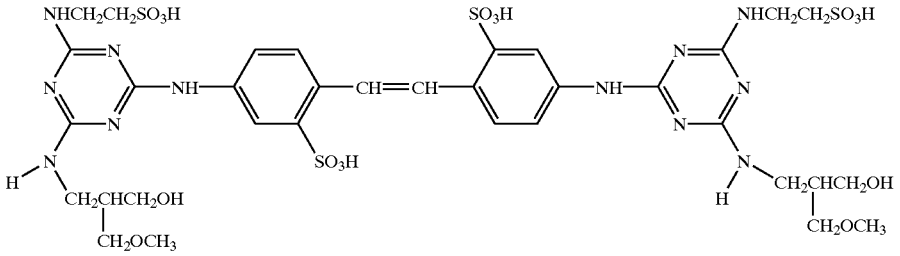

-continued
I-8)
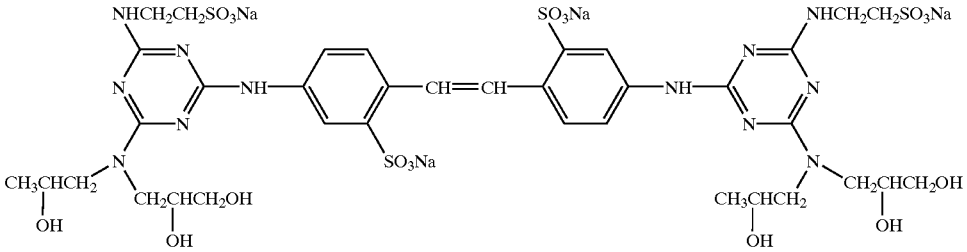
I-9)
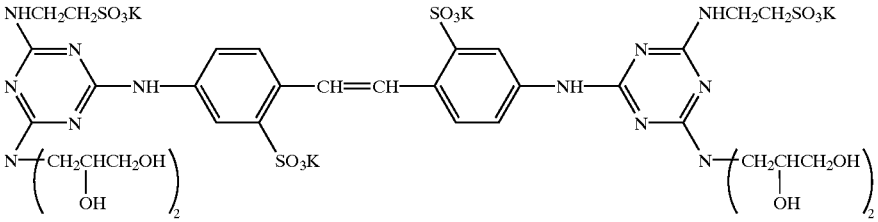
I-10)
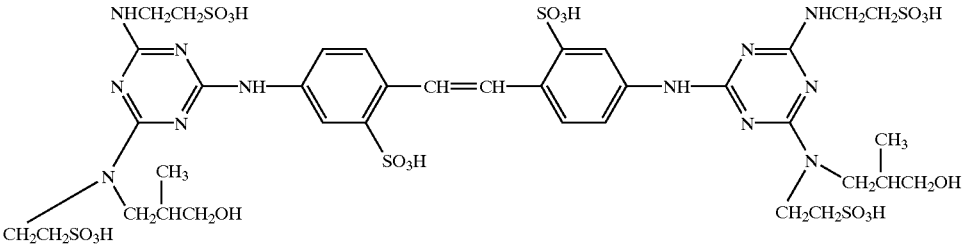
I-11)
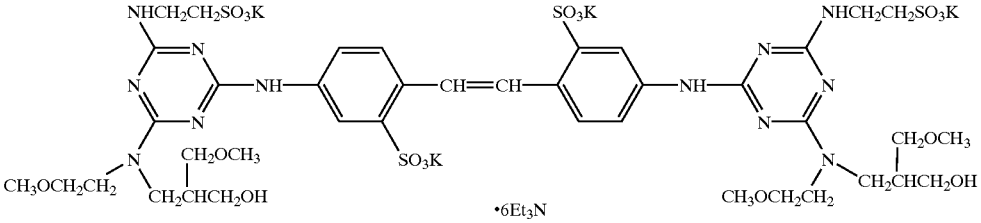
I-12)
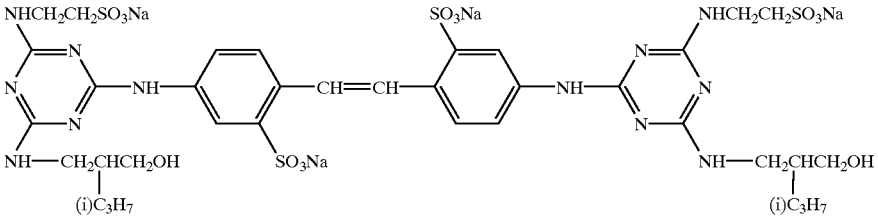

-continued
I-13)
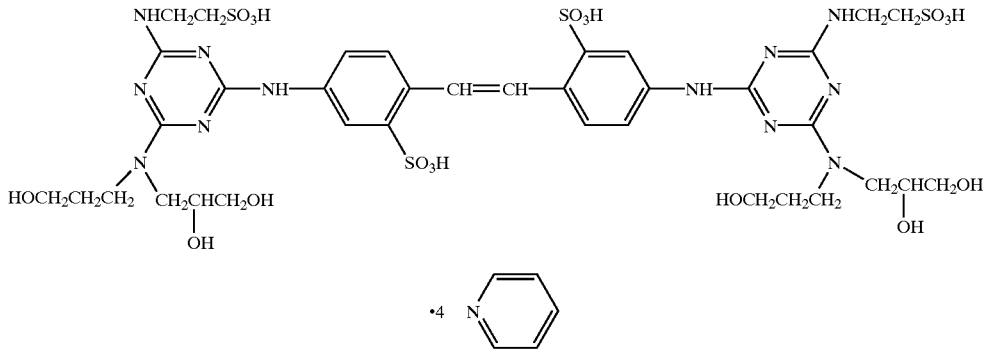
I-14)
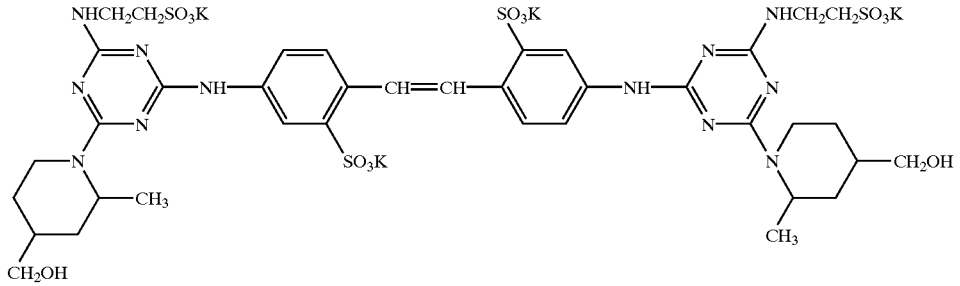
I-15)
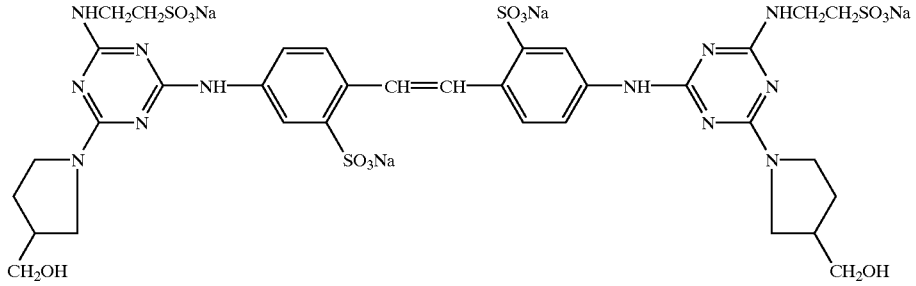
I-16)
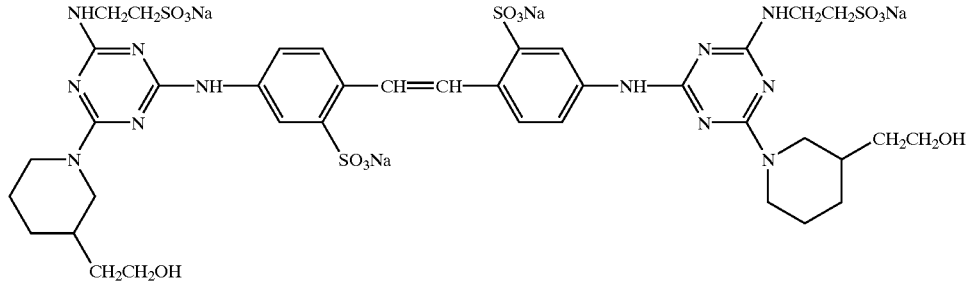
I-17)
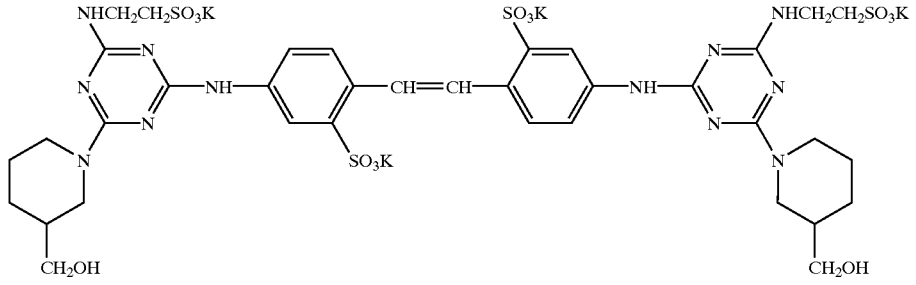

-continued
I-18)
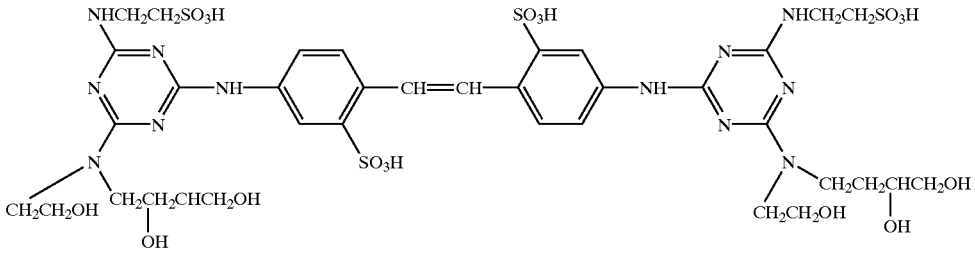
I-19)
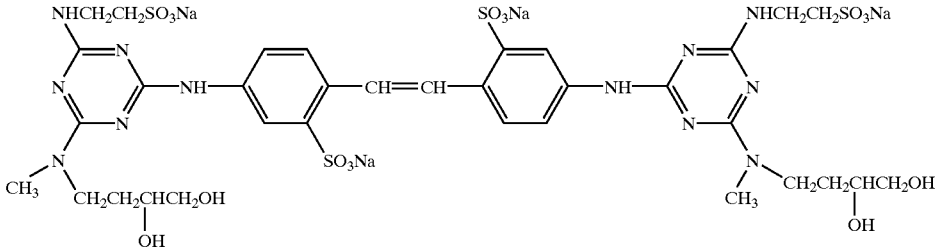
I-20)
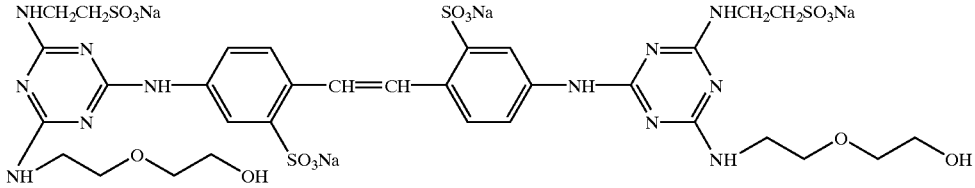
I-21)
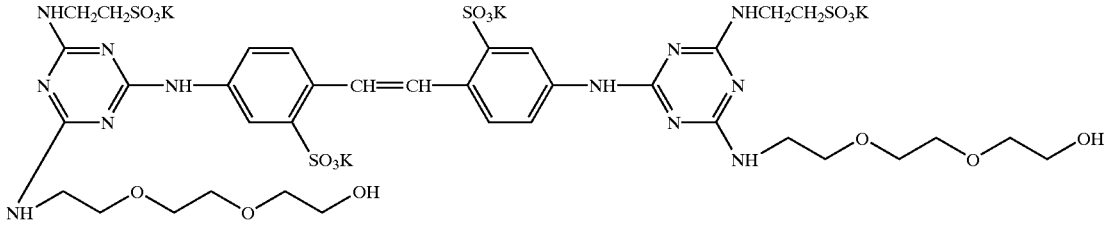
I-22)
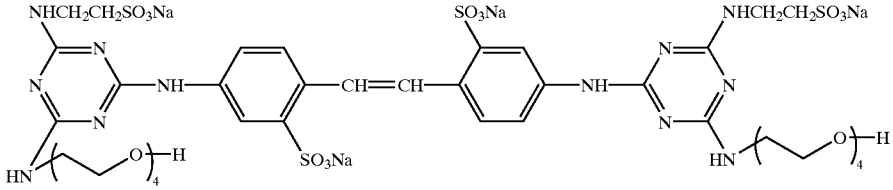
I-23)
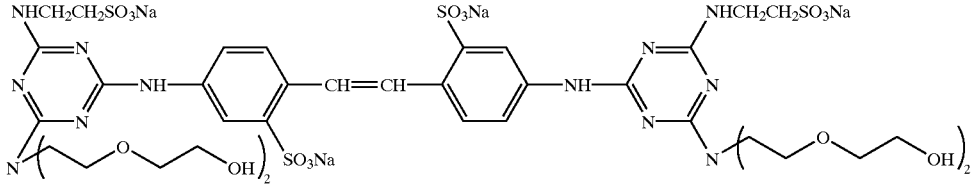

-continued
I-24)
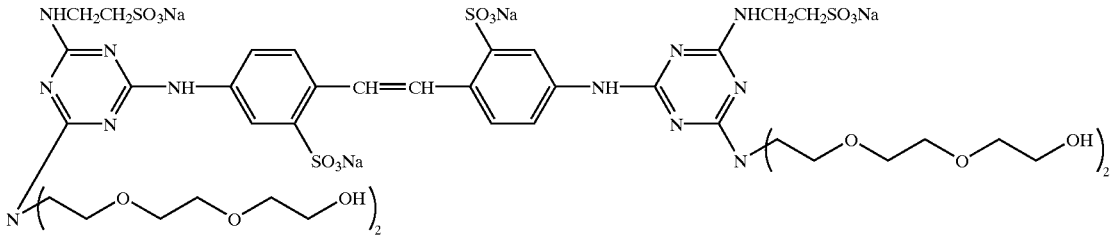
I-25)
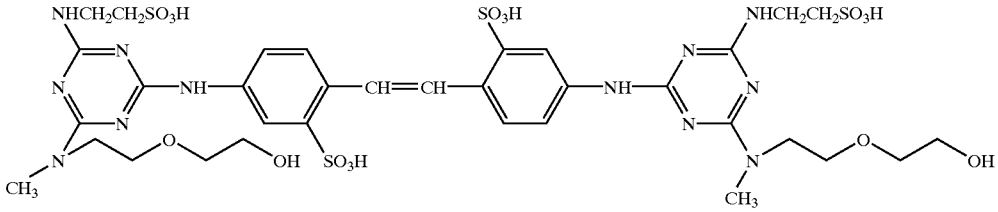
•4NMe$_3$
I-26)
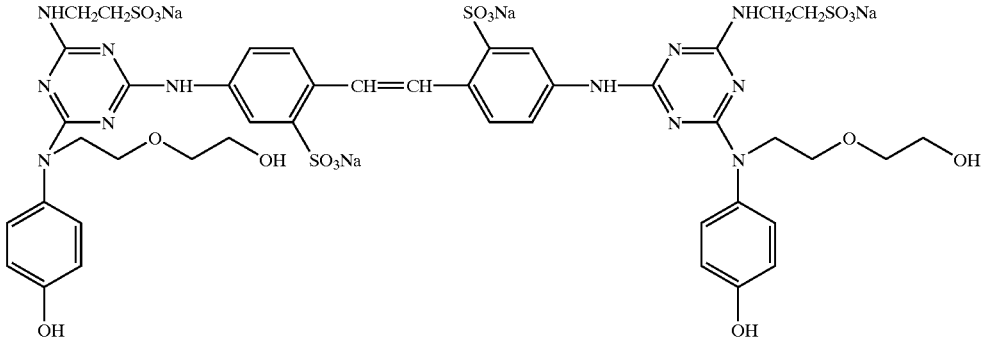
I-27)
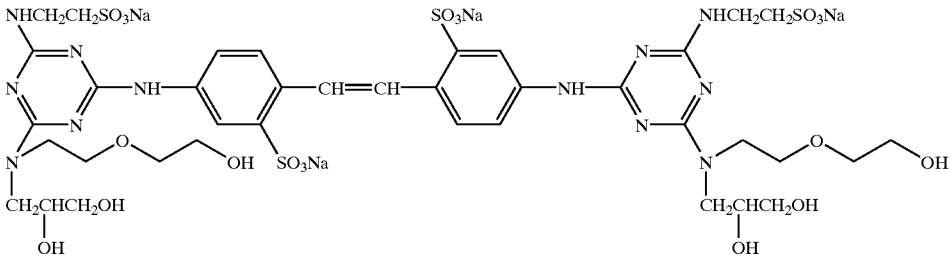
I-28)
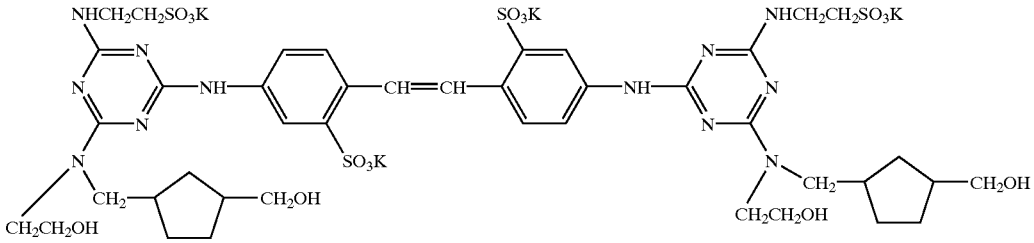

-continued
I-29)
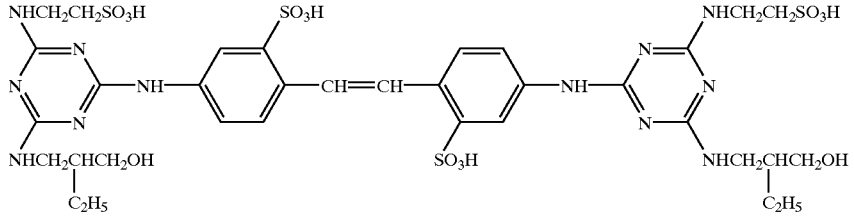
I-30)
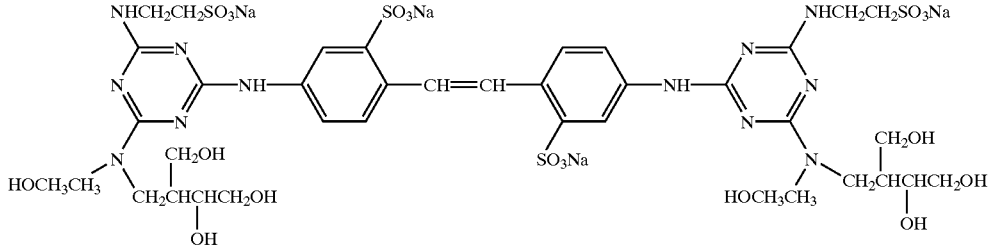
I-31)
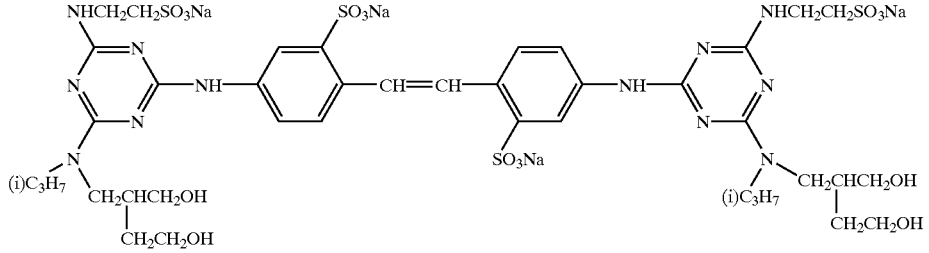
I-32)
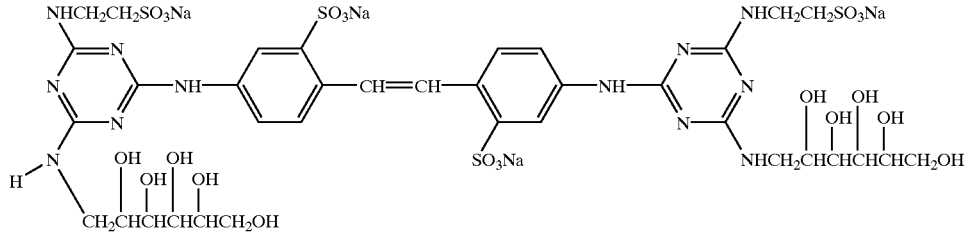
I-33)
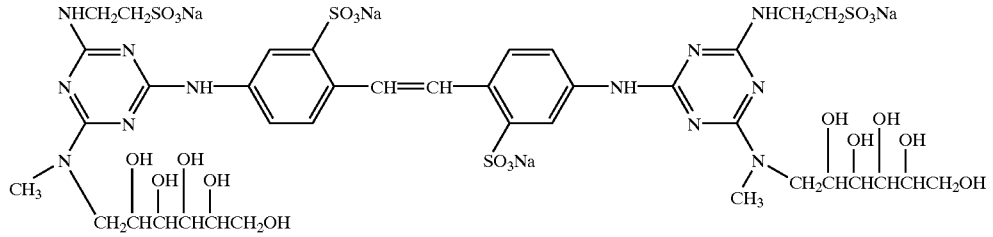
I-34)
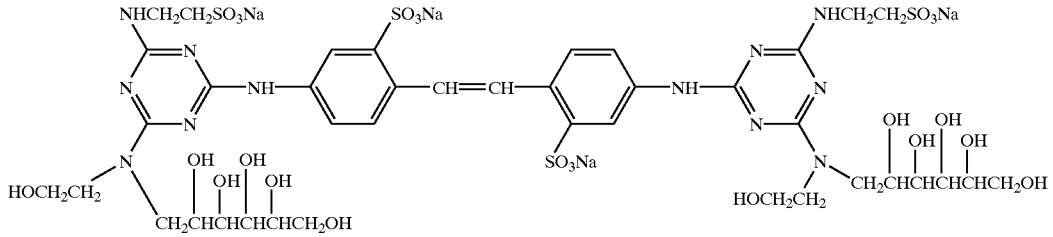

-continued
I-35)
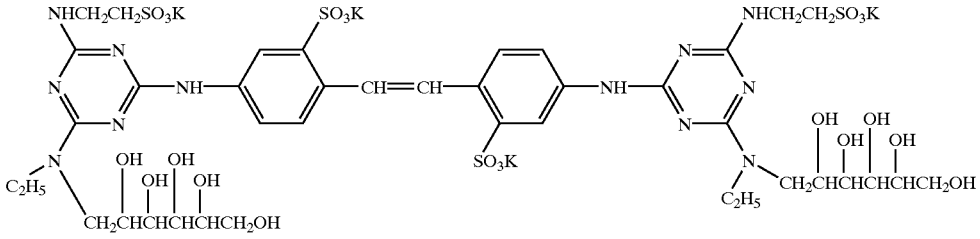
I-36)
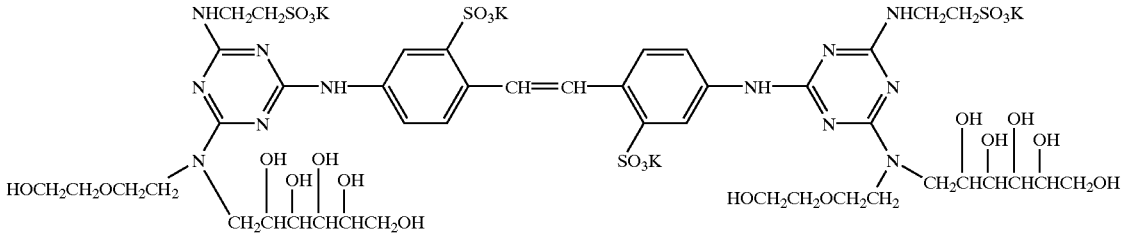
I-37)
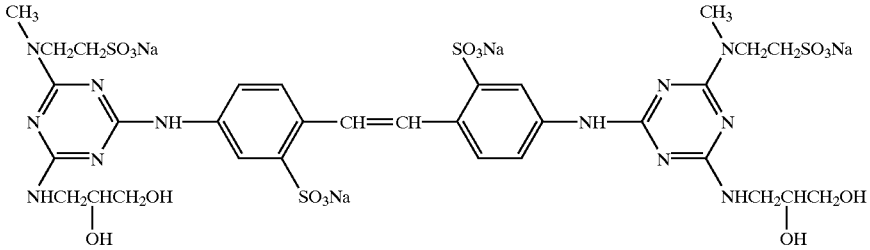
I-38)
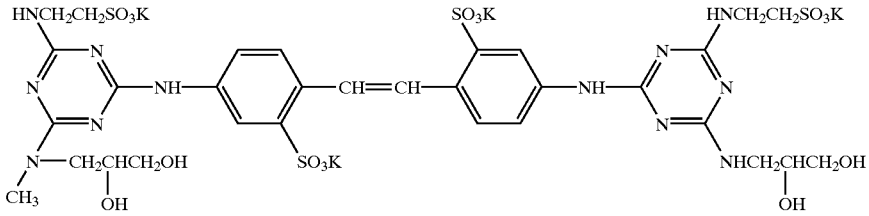
I-39)
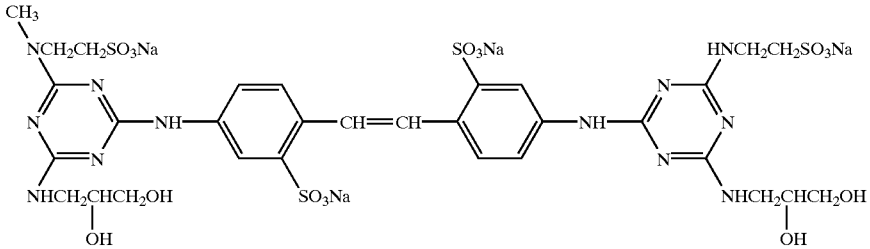
I-40)
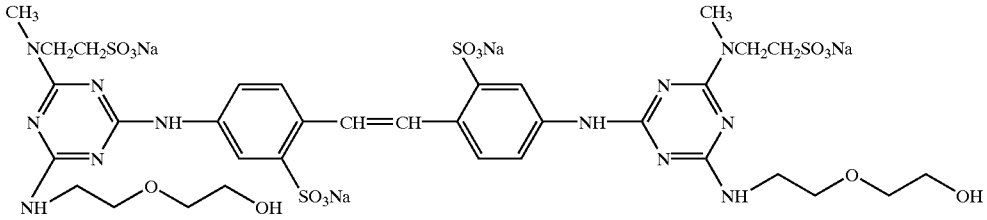

-continued
I-41)
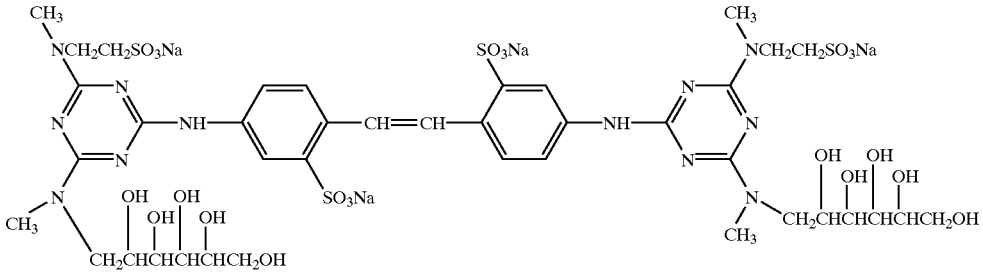
I-42)
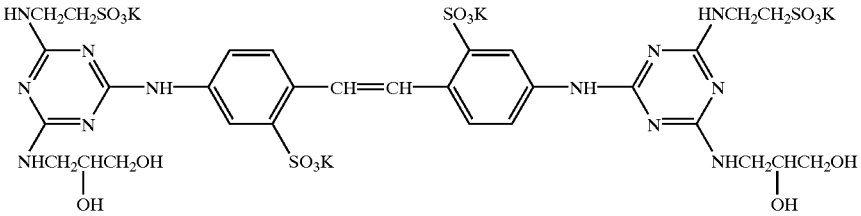
I-43)
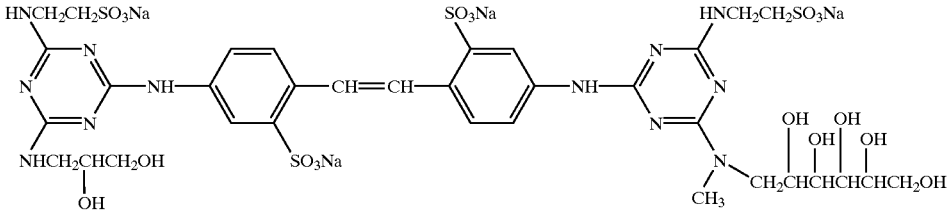
I-44)
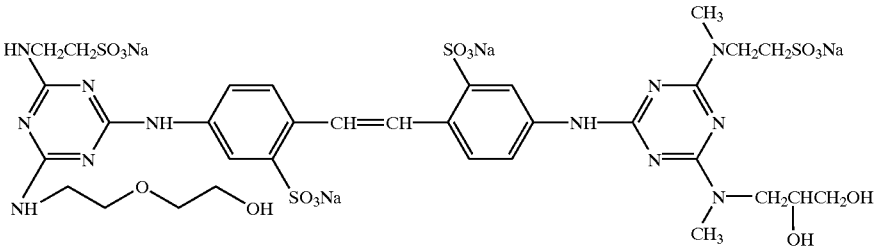
I-45)
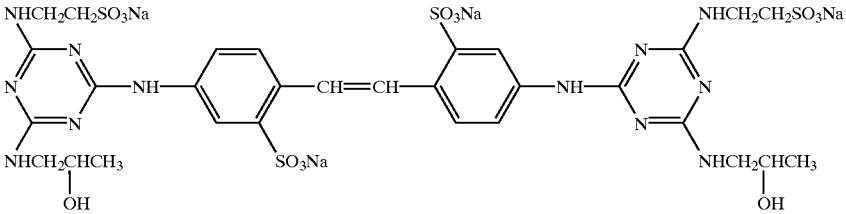
I-46)
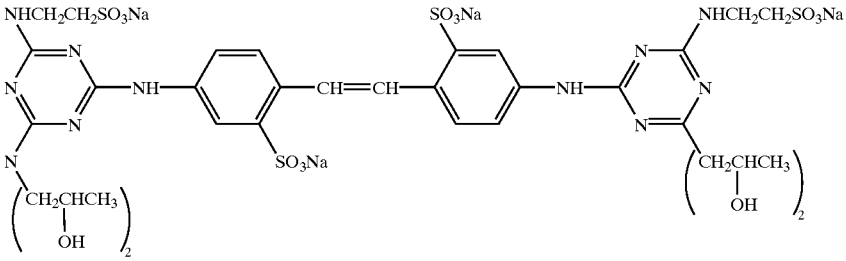

-continued

I-47)

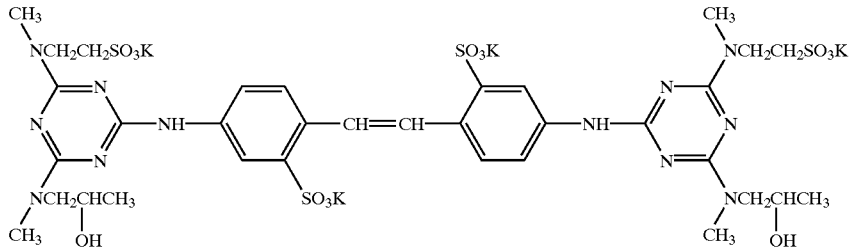

I-48)

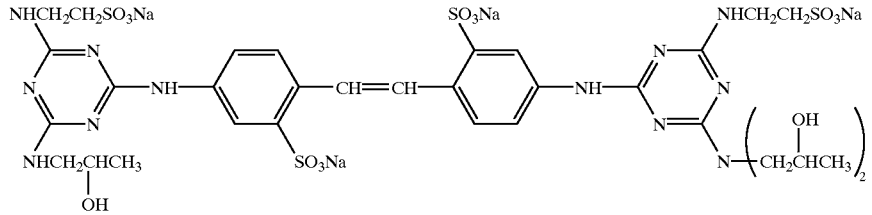

The compound represented by formula (I) can be synthesized with reference to the methods described, e.g., in Hirotsugu Matsui, *Yuki Gosei Kagaku Kyokai-shi* (*Bulletin of the Society of Organic Synthetic Chemistry*), Vol. 17, p. 528 (1959), and Japanese Patent 2,618,748. That is, a method of reacting cyanuric chloride with a diaminostilbene derivative and then with amines in order is preferred. Alternatively, it is also preferred to react a diaminostilbene derivative lastly. Water and an organic solvent, e.g., alcohols, ketones, ethers and amides are used as the solvent in the reaction, water and water-soluble organic solvents are preferred, and the mixed solvents of these solvents may be used. A mixed solvent of water and acetone is most preferred. As the bases to be used, organic bases, e.g., triethylamine, pyridine, and 1,8-diazabicyclo[5,4,0]-7-undecene, and inorganic bases, e.g., sodium hydroxide, potassium hydroxide, sodium carbonate, potassium carbonate, sodium bicarbonate, and sodium hydride, are exemplified. Inorganic bases are preferred, and sodiumhydroxide, potassiumhydroxide, sodium carbonate and potassium carbonate are preferred above all. The reaction can be performed at −20° C. to 120° C., preferably from −10° C. to 90° C. More specifically, it is preferred to perform the reaction at −10° C. to 10° C. in the first stage, from 0° C. to 40° C. in the second stage, and from 50° C. to 90° C. in the third stage.

SYNTHETIC EXAMPLE 1

Exemplified compound (I-1) in the present invention was synthesized according to the following reaction scheme.

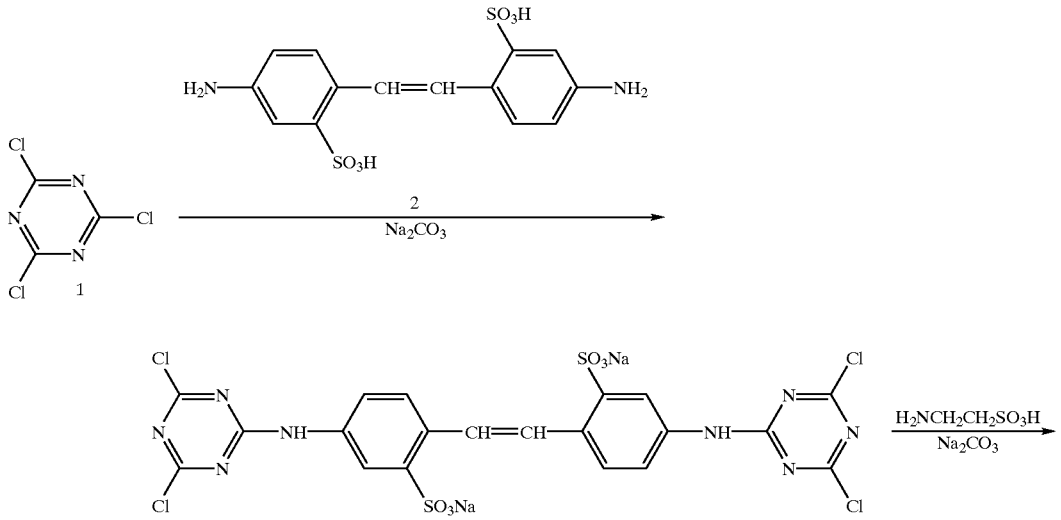

-continued

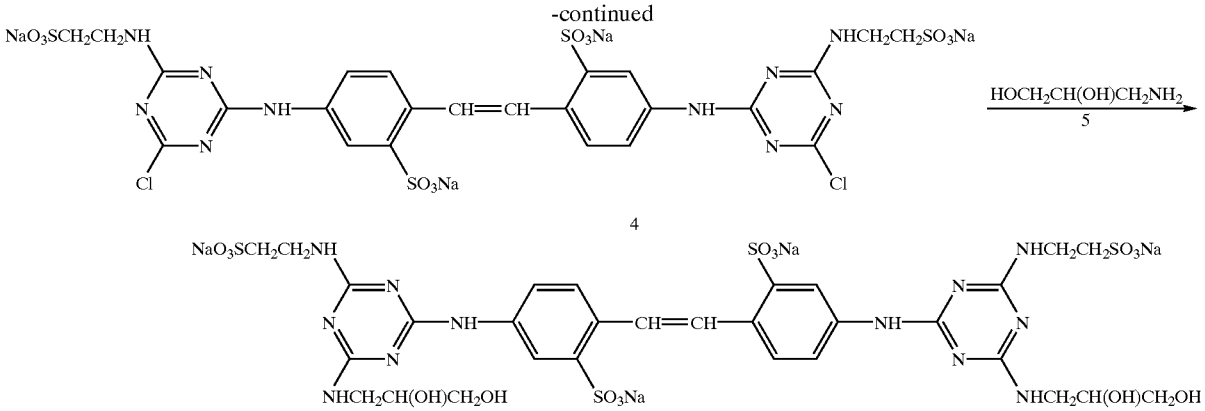

Exemplified Compound (I-1)

Synthesis of Compound (3)

Compound (1) (103.5 g) and 680 ml of acetone were put into a three-necked flask and the internal temperature was lowered to −5° C. in an ice-acetone bath, and an aqueous solution comprising 101.9 g of Compound (2), 58.3 g of sodium carbonate and 960 ml of water was dropwise added to the flask over 1 hour with stirring. The internal temperature was raised to −1° C. at this time. After the termination of the dripping, the ice-acetone bath was taken out, followed by stirring for 1 hour, and the precipitated crystals were filtered by suction filtration, thereby the objective Compound (3) was obtained. The obtained Compound (3) was used in the next step without drying and purification.

Synthesis of Compound (4)

Compound (3) obtained in the above step and 1.9 liters of water were put into a three-necked flask, 68.8 g of taurine was added thereto with stirring the reaction solution in a water bath, and then an aqueous solution comprising 275 ml of water having dissolved therein 58.3 g of sodium carbonate was dropwise added to the flask over 1 hour. After the termination of the dripping, the water bath was taken out, followed by stirring for 3 hours, 550 g of sodium chloride was then added thereto and the reaction solution was stirred for further 1 hour. The precipitated crystals were filtered by suction filtration, thereby the objective Compound (4) was obtained. Compound (4) was used in the next step without drying and purification.

Synthesis of Exemplified Compound (I-1)

Compound (4) obtained in the above step and 825 ml of water were put into a three-necked flask, and 125.3 g of Compound (5) was dropwise added thereto over 10 minutes with stirring the reaction solution at room temperature. After the termination of the dripping, the reaction solution was stirred for 3 hours at internal temperature of 85° C., and the obtained reaction mixture was concentrated by a rotary evaporator. Since crystals began to precipitate when the remaining amount of the reaction mixture reached 800 ml, the concentration was stopped, and the concentrate was stirred as it was with ice-cooling. The precipitated crystals were filtered by suction filtration, and 1.5 liters of methanol was added to the thus-obtained crystals, followed by stirring for 1 hour under refluxing with heating. The product was cooled to room temperature and suction filtered, thereby 206.0 g of the objective exemplified Compound (I-1) was obtained (yield: 72%).

$\lambda$max ($H_2O$)=346.3 nm ($\epsilon$=4.83×$10^4$).

The purity of the thus-obtained compound measured by liquid chromatography was 96.0%. The conditions of the liquid chromatography were as follows.

Column: TSK-gel, ODS-80TM (manufactured by Toso Co.)

Eluate: Solution A: 20 ml of PIC A reagent (manufactured by Waters Co.) was added to 1 liter of water.

Solution B 20 ml of PIC A reagent was added to a mixed liquid comprising 800 ml of methanol and 200 ml of water.

Solution A/Solution B=50/50 (0 min) was graded to 0/100 (35 min).

Detected wavelength: 346 nm

Purity was obtained from the area of the peak recorded on the chart on the above conditions.

SYNTHETIC EXAMPLE 2

Exemplified compound (I-20) in the present invention was synthesized according to the following reaction scheme,

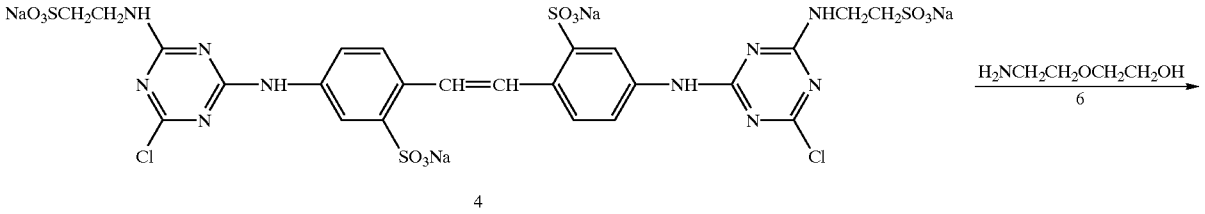

-continued

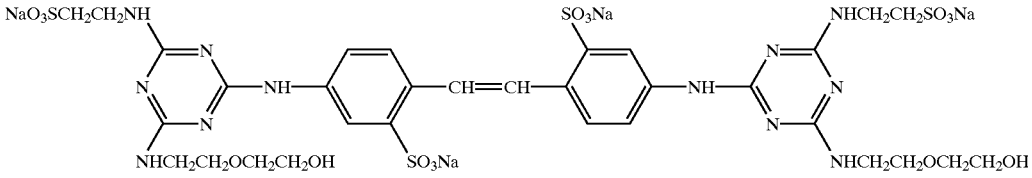

Exemplified Compound (I-20)

Synthesis of ExemElified Compound (I-20)

Compound (4) obtained in the same manner as in Synthesis Example 1 and 825 ml of water were put into a three-necked flask, and 144.4 g of Compound (6) was dropwise added thereto over 10 minutes with stirring the reaction solution at room temperature. After the termination of the dripping, the reaction solution was stirred for 3 hours at internal temperature of 85° C., and the obtained reaction mixture was concentrated by a rotary evaporator until the remaining amount of the reaction mixture reached 800 ml, and the concentrate was stirred as it was with ice-cooling. The precipitated crystals were filtered by suction filtration, and 1.5 liters of methanol was added to the thus-obtained crystals, followed by stirring for 1 hour under refluxing with heating. The product was cooled to room temperature and suction filtered, thereby 249.7 g of the objective exemplified Compound (I-20) was obtained (yield: 85%)

$\lambda$max ($H_2O$)=354.5 nm ($\epsilon$=4.92×10$^4$).

The purity of the thus-obtained compound measured by liquid chromatography was 97.3%. The conditions of the liquid chromatography were the same as those in Synthesis Example 1.

SYNTHETIC EXAMPLE 3

Exemplified compound (I-33) in the present invention was synthesized according to the following reaction scheme.

three-necked flask, and 268.5 g of Compound (7) was added thereto over 10 minutes with stirring the reaction solution at room temperature. After the termination of the addition, the reaction solution was stirred for 3 hours at internal temperature of 85° C., and the obtained reaction mixture was concentrated by a rotary evaporator until the remaining amount of the reaction mixture reached 900 ml, and the concentrate was stirred as it was with ice-cooling. The precipitated crystals were filtered by suction filtration, and 1.5 liters of methanol was added to the thus-obtained crystals, followed by stirring for 1 hour under refluxing with heating. The product was cooled to room temperature and suction filtered, thereby 302.4 g of the objective exemplified Compound (I-33) was obtained (yield: 88%).

$\lambda$max ($H_2O$)=348.6 nm ($\epsilon$=4.36×10$^4$).

The purity of the thus-obtained compound measured by liquid chromatography was ::96.1%. The conditions of the liquid chromatography were the same as those in Synthesis Example 1.

The compound represented by formula (I) is contained in the composition according to the present invention in an amount of from 1 to 50 g/liter of the amount of the composition, preferably from 1 to 10 g/liter, which amount is selected optimally according to the content of the color developing agent in the composition so that the coloring of a container can be inhibited and the color developing agent and the compound can be stably present in the composition.

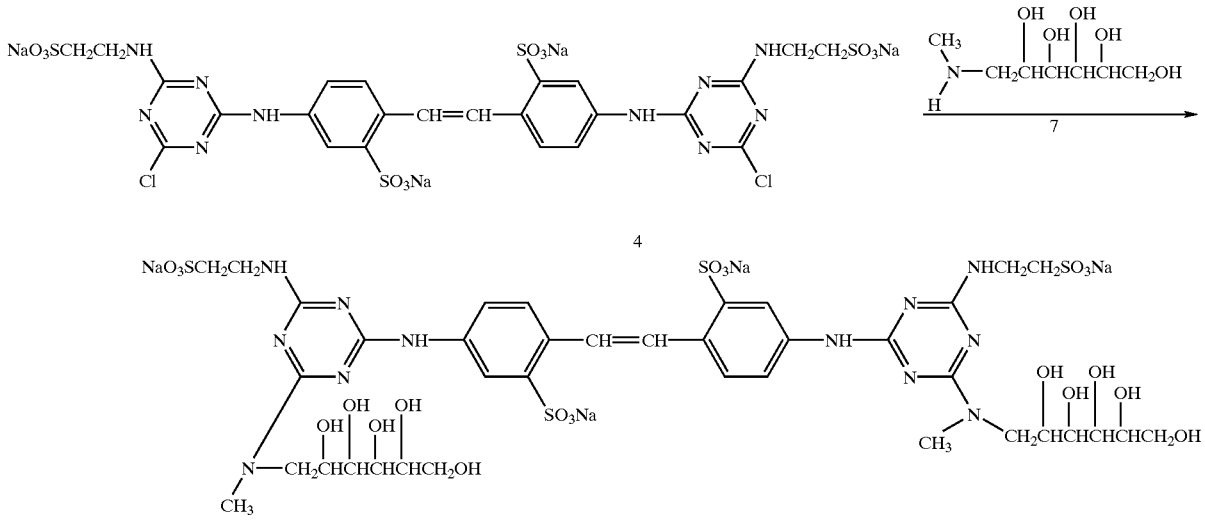

Exemplified Compound (I-33)

Synthesis of Exemplified Compound (I-33)

Compound (4) obtained in the same manner as in Synthesis Example 1 and 825 ml of water were put into a At least one glycol selected from ethylene glycol, diethylene glycol and triethylene glycol to be contained in the color development processing composition together with the compound represented by formula (I) may be any of the above three kinds of glycols, and mixture of them may be used. Diethylene glycol and triethylene glycol are preferred. The amount of glycols in the composition is from 5 to 100 g/liter of the amount of the composition, preferably from 5 to 80 g/liter, which amount is selected optimally according to the contents of the color developing agent and the compound represented by formula (I) in the composition.

The polyethylene glycol contained in the color development processing composition according to the present invention together with the compound represented by formula (I) and the compound selected from glycols has a number average molecular weight of 1,000 to 2,000, preferably from 1500 to 2,000. The content of the polyethylene glycol in the composition is from 1 to 20 g/liter of the amount of the composition, preferably from 2 to 10 g/liter, which amount is selected optimally according to the contents of the color developing agent and the compound represented by formula (I) in the composition so that the color developing agent and the compound represented by formula (I) can stably maintain the state of dissolution.

As the preferred development processing composition in the present invention, the content of a color developing agent is, in the case of, e.g., widely used 4-amino-3-methyl-N-ethyl-N-(β-hydroxyethyl)aniline sulfate or a salt of it, from 15 to 50 g/liter of the amount of the composition, preferably from 15 to 40 g/liter, the content of the compound represented by formula (I) is from 5 to 100 g/liter, preferably from 10 to 40 g/liter, the content in total of glycols is from 5 to 100 g/liter, preferably from 5 to 60 g/liter, and the content of polyethylene glycol is from 1 to 20 g/liter, preferably from 2 to 10 g/liter.

The development processing composition according to the present invention contains 4-amino-3-methyl-N-ethyl-N-(β-hydroxyethyl) aniline or a salt of it as a color developing agent, and is particularly suitable in the case of development[]processing of color negative films. Further, the effect of the present invention is conspicuously exhibited in the case where the composition is supplied in the form of a concentrated liquid processing agent greatly restricted by the coloring of containers and solubility. When the liquid development processing composition in the present invention is used as a replenisher, the composition may be used as a replenisher by being added to the replenishing tank of an automatic processor and diluted with water, or may be replenished by direct pouring to a color developing tank from the container of the composition via a liquid feeding pump (water is also supplied through different piping in this case) in proportion to the development processing amount.

The constitutional components of the development processing composition according to the present invention besides those described above are described below.

The development processing composition contains a color developing agent, but the present invention is not limited to the above-described particularly preferred color developing agents, and other well-known aromatic primary amine color developing agents, in particular, p-phenylenediamine derivatives can be used. The representative examples of p-phenylenediamine derivatives are shown below, but the present invention is not limited thereto. Furthermore, in recent years, there are some black-and-white photographic materials to which couplers have been added so as to be colored black to form a black-and-white image with a widely used general color developing solution, and the color developing solution in the present invention is also applied to these kinds of photographic materials.

1) N,N-Diethyl-p-phenylenediamine
2) 4-Amino-3-methyl-N,N-diethylaniline
3) 4-Amino-N-(β-hydroxyethyl)-N-methylaniline
4) 4-Amino-N-ethyl-N-(β-hydroxyethyl)aniline
5) 4-Amino-3-methyl-N-ethyl-N-(β-hydroxyethyl)aniline
6) 4-Amino-3-methyl-N-ethyl-N-(3-hydroxypropyl)aniline
7) 4-Amino-3-methyl-N-ethyl-N-(4-hydroxybutyl)aniline
8) 4-Amino-3-methyl-N-ethyl-N-(β-methanesulfonamidoethyl)aniline
9) 4-Amino-N,N-diethyl-3-(β-hydroxyethyl)aniline
10) 4-Amino-3-methyl-N-ethyl-N-(β-methoxyethyl)aniline
11) 4-Amino-3-methyl-N-(β-ethoxyethyl)-N-ethylaniline
12) 4-Amino-3-methyl-N-(3-carbamoylpropyl)-N-n-propylaniline
13) 4-Amino-3-methyl-N-(4-carbamoylbutyl)-N-n-propylaniline
14) N-(4-Amino-3-methylphenyl)-3-hydroxypyrrolidine
15) N-(4-Amino-3-methylphenyl)-3-(hydroxymethyl) pyrrolidine
16) N-(4-Amino-3-methylphenyl)-3-pyrrolidinecarboxamide Of the above p-phenylenediamine derivatives, preferred compounds are Compounds 5), 6), 7), 8) and 12), and Compounds 5) and 8) are particularly preferred. When these p-phenylenediamine derivatives are in solid states, they generally take the form of salts such as sulfate, hydrochloride, sulfite, naphthalenedisulfonate, and p-toluenesulfonate. These processing compositions are mixed with water in a prescribed ratio and used as the working solution of a developing replenisher (or a further diluted developing solution). The concentration of the aromatic primary amine developing agent in the working solution is preferably from 2 to 200 mmol, more preferably from 12 to 200 mmol, and still more preferably from 12 to 150 mmol, per liter of the developing solution.

The processing agent composition in the present invention contains a small amount of sulfite ions in some case according to the objective photographic material, or does not substantially contain in another case. This is because a sulfite ion in some cases adversely affects photographic characteristics during color developing process when excessively used, although it has conspicuous preservative property.

Hydroxylamine is also contained in the constitutional components of the composition or is not contained according to the kinds of materials to be used, because hydroxylamine sometimes affects photographic characteristics since it has silver development activity concurrently with the function as the preservative of a developing solution.

It is preferred for the processing composition in the present invention to contain inorganic preservatives such as the above hydroxylamines and sulfite ions and organic preservatives. Organic preservatives here means organic compounds at large which reduce the deterioration speed of the aromatic primary amine color developing agent when added to the processing solution of a photographic material. That is, organic preservatives means organic compounds which have functions to prevent the air oxidation of color developing agents and, above all, hydroxylamine derivatives, hydroxamic acids, hydrazides, phenols, α-hydroxyketones, α-aminoketones, saccharides, monoamines, diamines, polyamines, quaternary ammonium salts, nitroxy radicals, alcohols, oximes, diamide compounds, and condensed cyclic amines are particularly effective organic preservatives. These organic preservatives are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503, 2,494,903, JP-A-52-143020, and JP-B-48-30496 (the term "JP-B" as used herein means an "examined Japanese patent publication").

In addition, the various metals disclosed in JP-A-57-44148 and JP-A-57-53749, the salicylic acids disclosed in JP-A-59-180588, the alkanolamines disclosed in JP-A-54-3532, the polyethyleneimines disclosed in JP-A-56-94349, and the aromatic polyhydroxyl compounds disclosed in U.S. Pat. No. 3,746,544 may be used as preservatives, if necessary. The addition of alkanolamines other than the alkanolamines described above, e.g., triethanolamine and triisopropanolamine, substituted or unsubstituted dialkylhydroxylamine such as disulfoethylhydroxylamine and diethylhydroxylamine, or aromatic polyhydroxyl compounds is particularly preferred.

Of the above organic preservatives, hydroxylamine derivatives are particularly preferably used, and the details thereof are disclosed in JP-A-1-97953, JP-A-l-186939, JP-A-1-186940, and JP-A-1-187557. The combined use of hydroxylamine derivatives with amines is particularly preferred from the point of the improvement of stability of the color developing solution and the improvement of stability at continuous processing.

As the above-described amines, the cyclic amines as disclosed in JP-A-63-239447, the amines as disclosed in JP-A-63-128340, and the amines as disclosed in JP-A-1-186939 and JP-A-1-187557 can be exemplified.

Chlorine ions may be added to the concentrated processing agent composition according to the present invention, if necessary. In many cases, a color developing solution (in particular, a color developing solution for color print materials) generally contains chlorine ions in an amount of from $3.5\times10^{-2}$ to $1.5\times10^{-1}$ mol/liter, but since chlorine ions are generally released into a developing solution as a by-product of development, the addition to a replenisher is not necessary in many cases. The amount of the chlorine ion in a replenisher, i.e., in the original processing agent composition, is set up so that the chlorine ion concentration in a developing tank of the time when reached running equilibrium composition becomes the above-described level of concentration. In many developing solutions for photographic materials for printing, when the concentration of the chlorine ion is higher than $1.5\times10^{-1}$ mol/liter, the development is delayed, which is disadvantageous since rapid development property and color density are impaired. If the concentration is lower than $3.5\times10^{-2}$ mol/liter, it is not preferred in many cases for preventing fog. Since many silver halide photographic materials for photographing generally substantially do not contain silver chloride, the control of chlorine ion concentration at development processing is not necessary and the processing agent compositions used do not generally contain chlorine ions as the constitutional component.

With respect to the processing agent composition, similarly to the chlorine ion, since bromine ions are also dissolved out from a photographic material into a processing solution and accumulate, the concentration of bromine ions is controlled so as to maintain equilibrium concentration. The concentration of bromine ions in a color developing solution is preferably from 1 to $5\times10^{-3}$ mol/liter or so for materials for photographing and $1.0\times10^{-3}$ mol/liter or less for materials for printing. Bromine ions may be added to the processing agent composition according to necessity so as to reach the above bromine ion concentration range.

Iodine ions are dissolved out from color photographic materials for photographing into a developing solution but photographic materials for printing generally do not contain silver iodide. The concentration of iodine ions in a developing solution is from $5\times10^{-5}$ mol/liter to $5\times10^{-4}$ mol/liter or so and, if necessary, iodine ions may be added to the processing agent composition for maintaining the concentration When halide ions are added to the processing agent composition, sodium chloride, potassium chloride, ammonium chloride, lithium chloride, nickel chloride, magnesium chloride, manganese chloride, and calcium chloride can be exemplified as chlorine ion-supplying substances. Sodium chloride and potassium chloride are preferred of these.

As bromine ion-supplying substances, sodium bromide, potassium bromide, ammonium bromide, lithium bromide, calcium bromide, magnesium bromide, manganese bromide, nickel bromide, cerium bromide and thallium bromide can be exemplified. Potassium bromide and sodium bromide are preferred of these.

As iodine ion-supplying substances, sodium iodide, potassium iodide, lithium iodide, calcium iodide, magnesium iodide, and thallium iodide can be exemplified. Potassium iodide and sodium iodide are preferred of these.

When the photographic material to be processed is color paper, since it is an important picture quality that the white background of the picture plane is white, it is important to finish the color paper white in appearance with a fluorescent brightening agent. Fluorescent brightening agents are added to a photographic material according to their properties but fluorescent brightening agents may permeate a photographic material from a processing solution in development processing. In such a case, for the purpose of obtaining a high whitening effect, appropriate processing solutions accordant to the object are selected according to the properties of the fluorescent brightening agents. Therefore, there are cases where fluorescent brightening agents are added to color developing solutions having high pH values.

In many cases stilbene-based fluorescent brightening agents are used, in particular, bis(triazinylamino)stilbene-based and 4,4'-diamino-2,2'-disulfostilbene-based fluorescent brightening agents are preferably used. Particularly preferred stilbene-based fluorescent brightening agent is 4,4'-ditriazinylamino-2,2'-disulfostilbene.

Conventionally well-known easily available stilbene-based fluorescent brightening agents can be used in the present invention, or they can be easily synthesized according to well-known methods.

The stilbene-based fluorescent brightening agents may be added to a desilvering solution or a photographic material as well as a color developing solution, and when added to a color developing solution, the concentration is preferably from $1\times10^{-4}$ to $5\times10^{-2}$ mol/liter, more preferably from $2\times10^{-4}$ to $1\times10^{-2}$ mol/liter. The addition amount of the processing composition in the present invention is determined so that the working developing solution contains a fluorescent brightening agent in this concentration.

The processing composition according to the present invention, in the case of a concentrated liquid processing agent composition, preferably has pH of from 9.5 to 13.5, but the color developing solution prepared therefrom has pH of preferably from 9.0 to 12.2, more preferably from 9.9 to 11.2, and other well-known developing solution components can be contained.

Various alkali agents and buffers are preferably used for maintaining the above pH level. The examples of alkali agents and buffers which can be used include carbonate, phosphate, borate, tetraborate, hydroxybenzoate, glycyl salt, N,N-dimethylglycine salt, leucine salt, norleucine salt, guanine salt, 3,4-dihydroxyphenylalanine salt, alanine salt, aminobutyrate, 2-amino-2-methyl-1,3-propanediol salt, valine salt, proline salt, trishydroxyaminomethane salt, and lysine salt. Carbonate, phosphate, tetraborate and hydroxybenzoate are particularly excellent in buffering ability in a high pH range of pH 9.0 or more, and do not adversely affect photographic performances (e.g., causing fog) when addedtoa color developing solution and inexpensive,, therefore, the use of these buffers is particularly preferred. Buffers are added to the composition in concentration of from 0.01 to 2 mol, preferably from 0.1 to 0.5 mol, per mol of the developing replenisher. Alkali agents are added to adjust the pH of the developing solutions in which buffers are contained to a prescribed value.

The specific examples of these alkali agents and buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfo-salicylate), potassium 5-sulfo-2-hydroxybenzoate (potassium 5-sulfo-salicylate), sodiumhydroxide, potassiumhydroxide, and lithium hydroxide. However, the present invention is not limited to these compounds.

The above buffers are added to the color developing replenisher prepared by dilution in concentration of preferably 0.1 mol/liter or more, and particularly preferably from 0.1 mol/liter to 0.4 mol/liter.

In the present invention, potassium hydroxide is preferably used as an alkali agent in addition to potassium carbonate, in particular it is preferred to use potassium hydroxide by substituting a part of potassium hydroxide with lithium hydroxide, which further improves the precipitation preventing effect of a developing kit.

Various chelating agents, which are precipitation preventing agents of other components of color developing solution, e.g., calcium and magnesium, or stability improving agents of the color developing solution, can be used in the processing composition according to the present invention. The examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, trans-cyclohexanediaminetetraacetic acid, 1,2-diaminopropanetetraacetic acid, glycol ether diaminetetraacetic acid, ethylenediamine-o-hydroxyphenylacetic acid, ethylenediaminedisuccinic acid (SS body), N-(2-carboxylatoethyl)-L-aspartic acid, β-alaninediacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and 1,2-dihydroxybenzene-4,6-disulfonic acid.

These chelating agents may be used in combination of two or more of them, if required.

The addition amount of these chelating agents should be sufficient to sequester metal ions in a color developing solution,e.g., about 0.1 g to 10 g per liter of a color developing solution.

The processing composition according to the present invention can contain a development accelerator, if desired.

For example, the thioether-based compounds disclosed in JP-B-37-16088, JP-B-37-5987, JP-B-38-7826, JP-B-44-12380, JP-B-45-9019 and U.S. Pat. No. 3,813,247, the p-phenylenediamine-based compounds disclosed in JP-A-52-49829 and JP-A-50-15554, the quaternary ammonium salts disclosed in JP-A-50-137726, JP-B-44-30074, JP-A-56-156826 and JP-A-52-43429, the amine-based compounds disclosed in U.S. Pat. Nos. 2,494,903, 3,128,182, 4,230,796, 3,253,919, JP-B-41-11431, U.S. Pat. Nos. 2,482,546, 2,596,926, and 3,582,346, and the polyalkylene oxides disclosed in JP-B-37-16088, JP-B-42-25201, U.S. Pat. No. 3,128,183, JP-B-41-11431, JP-B-42-23883 and U.S. Pat. No. 3,532,501, and also 1-phenyl-3-pyrazolidones and imidazoles can be added as.a development accelerator, if necessary.

An arbitrary antifoggant can be added to the processing agent composition in the present invention, if desired. Alkali metal halides such as sodium chloride, potassium bromide and potassium iodide, and organic antifoggants can be used as an antifoggant. The representative examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine. When an organic antifoggant is used, the addition amount is set up so that the concentration of the antifoggant in 1 liter of the developing solution or developing replenisher prepared from the processing agent composition falls within the range of from 0.05 to 5 mmol.

Besides the surfactants according to the present invention, various surfactants can be used if necessary, e.g., alkylsulfonic acid, arylsulfonic acid, aliphatic carboxylic acid, and aromatic carboxylic acid can be used.

The color developer composition and the color developing replenisher orthe color developing solution prepared therefrom for use in the present invention are as described above.

When the photographic material to be development processed is a color print material, the color development processing temperature applied to the present invention is from 30 to 55° C., preferably from 35 to 55° C., and more preferably from 40 to 55° C. The development processing time is from 5 to 90 seconds, preferably from 15 to 60 seconds. The replenishing rate is preferably less, but is generally appropriately from 20 to 600 ml, preferably from 30 to 120 ml, and particularly preferably from 15 to 60 ml, per $m^2$ of the photographic material.

On the other hand., when the photographic material to be development processed is a color negative film or a color reversal film, the development processing temperature is from 30 to 55° C., preferably from 35 to 55° C., and more preferably from 40 to 55° C., and the development processing time is from 20 seconds to 6 minutes, preferably from 30 to 200 seconds, and more preferably from 60 to 150 seconds. In particular, from 1 to 4 minutes is preferred with the case of a color negative film. The replenishing rate is preferably less, but is generally appropriately from 20 to 1,000 ml, preferably from 50 to 600 ml, and particularly preferably from 100 to 400 ml, per $m^2$ of the photographic material. When the concentrated replenisher composition and water are separately added to a developing tank, the replenishing amount is the total of the replenisher composition and water.

The present invention is particularly preferably applied to color negative processing.

The development processing composition in the present invention is characterized in that the composition can be thickened in extremely high concentration and one technical characteristic is that the restrictions of the thickening have been overcome. Therefore, the development processing composition in the present invention is suitable for the form of supply of a highly concentrated processing agent. The degree of concentration is from 1.5 to 10 times, preferably from 2 to 8 times, and more preferably from 3 to 5 times, as high as the solution in working state, i.e., the developing replenisher or the mother solution (the solution in a tank).

It is advantageous that the concentrated developer composition according to the present invention take the form that all the components to be contained in a working solution is contained in one composition, i.e., one-part constitution, but the constitutional components may be separated to two or more liquid parts to make a developer composition of two-part or three-part constitution when it is not preferred for the constitutional components to be kept in contact with each other for a long period of time (generally called as one-part, two-part or three-part constitution according to International Standard, ISO 5989), and the effect and the characteristics of the present invention are not lost by dividing the concentrated developer composition to some parts. The developer composition according to the present invention is particularly preferably used as one-part constitution.

The container for the concentrated liquid developer according to the present invention will be described below. It is advantageous in the present invention that the developer can be supplied with being contained in a polyethylene container.

In general, a liquid developer composition is contained in an appropriate container and transported, stored and used. The first requisite as to the material of a developer container is that it should be inactive to the developer composition and sufficiently stable (requisite 1). The requisite as important as requisite 1 is that the container must have sufficient oxygen barrier property not to cause air oxidation (requisite 2) throughout the period from the production of the developer composition to the use thereof. An additional desired condition is that the waste container is recyclable (requisite 3). Since the development activity of the concentrated liquid development processing agent is reduced with the lowering of the pH during storage, it is preferred to avoid contact with carbon dioxide in the air. Therefore, the material of the container should be such that the container wall has impermeability to carbon dioxide (requisite 4) as well as oxygen barrier. Almost all the materials which satisfy requisite 2 also satisfy requisite 4.

From the viewpoint of requisites 2 and 4, it is advantageous to put a developer composition into an oxygen- and carbon dioxide-barrier container and preserve and transport it. From the practical useful life of a developer composition, it is preferred to design the material and the thickness of a container so that the air permeation rate of unit time per unit area in the air of normal temperature and normal pressure becomes $2.5\times10^{-12}$ $cm^3/cm^2/sec/Pa$ or less, preferably $2.5\times10^{-13}$ $cm^3/cm^2/sec/Pa$ or less. On the other hand, from the viewpoint of requisite 4, containers of the materials having the permeation rate to carbon dioxide of the container wall of $7\times10^{-12}$ $cm^3/cm^2/sec/Pa$ or less have been thought to be desired. Therefore, materials of the container have been largely restricted.

From the point of impermeability to gases, liquid development processing agents were in many cases put in a glass bottles and supplied in a sealed state at the beginning in practical use. However, since glass bottles are heavy in weight and liable to be broken, bottles made of laminated materials comprising plastics having a high property of gas barrier and plastics stable to alkaline developers have come to be used in general. Although these well-known composite plastic materials effectively exclude air to prevent air (oxygen) oxidation, and increase the storage stability of liquid developers, it is difficult, on the other hand, to reclaim the containers on account of being composite materials and they are discarded as non-returnable containers at every use, which increases environmental load.

Preferred examples of the materials for the container of the color developer of the present invention include polyester resin, acrylate resin, ABS resin, epoxy resin and polyamide resin such as nylon, polyurethane resin, polystyrene resin, polycarbonate resin, PVA, polyvinyl chloride, polyvinylidene chloride, and polyethylene resin. Of these, containers consisting of polyester resin such as polyethylene terephthalate or polyethylene naphthalate, or polyolefin resin such as polyethylene and polypropylene as a single material are preferred. Polyethylene is preferred of all, and of polyethylenes, high density polyethylene, the so-called HDPE, is preferred as the material of the container. Particularly preferred HDPE has density of from 0.951 to 0.9769 $g/cm^3$. HDPE having the density within this range and a melt index of from 0.3 to 7.0, more preferably from 0.3 to 5.0, is convenient in gas permeability and molding property. Hollow molding is convenient for molding the container for the purpose of maintaining dimensional accuracy and thickness uniformity.

Pigments which do not exert adverse influence upon an alkaline developer composition, e.g., carbon black and titanium white, calcium carbonate, and plasticizers compatible with polyethylene may be added, if necessary, to the polyethylene for use in the container of the concentrated liquid developer composition of the present invention. Containers in which the percentage of polyethylene is 85% or more and do not contain a plasticizer are preferred, and those having the percentage of polyethylene of 95% or more and not containing a plasticizer are more preferred.

The shape and the structure of the container to be filled with the concentrated liquid developer composition of the present invention can be designed arbitrarily according to the purpose. Besides the regular bottle structures, containers of a type capable of expansion and contraction as disclosed in JP-A-58-97046, JP-A-63-50839, JP-A-1-235950 and JP-A-63-45555, and containers with a flexible bulkhead as disclosed in JP-A-58-52065, JP-A-62-246061 and JP-A-62-134626 can also be used.

When the container is charged with the developer composition, it is preferred to fill the developer composition to the mouth of the container as far as possible and minimize the upper space for further heightening the safety to air oxidation, or to fill the developer composition so as to get out of contact with oxygen in the air by substituting the upper space with nitrogen, but the present invention is not limited to these filling methods.

When the developer composition according to the present invention is used in an automatic processor, the container charged with the developer composition is installed in a processor and the composition in the container is injected into a developing replenisher tank or directly into a developing tank, the inside of the container is washed with a prescribed amount of water, the water used for washing is then introduced into the replenisher tank,and used as the water for preparing the replenisher, and development is performed using the thus-obtained replenisher. This is the method most effectively utilizing the advantage of the present invention. For washing the inside of the container with a prescribed amount of water, spray system washing is particularly preferred but the present invention is not limited to this method. Washing water is effectually used by this replenisher preparation method, as a result, the discharging amount of a waste solution from a developing laboratory can be reduced.

Accordingly, particularly advantageous embodiment of the present invention is the development processing system which is simple and the environmental safety and the working safety are ensured by the integration of the above-described developer composition. For example, development processing of a silver halide color photographic material can be performed with an automatic processor according to the method of, e.g., installing the container charged with the developer composition in the processor, injecting the composition in the container into a developing replenisher tank, spray-washing the inside of the container and washing away the processing components adhered on the container wall, and using the water used in washing for the preparation of the replenisher. In this case, the setup of automatically opening the cap of the container and smoothly discharging the fluidized content when the container of the developer composition is installed in the automatic processor is provided. Further, according to the methods disclosed in JP-A-6-82988 and JP-A-8-220722, the inside of the container can be washed by spraying with washing water without necessitating hands, and the recycling of the waste container becomes easy since it can be handled cleanly. In addition, since the washing water is reused as a part of the water for dissolving the developer, there is no need to discard the water as waste solution. The concept of such a system can be realized for the first time by the developer composition embodied according to the present invention which is highly concentrated and compact content, easy to handle, and has sufficient fluidity for a long period of time.

The developer composition according to the present invention can be prepared according to some methods. The following three methods bring about good results. However, it should not be construed as the present invention is limited to the following three methods.

Method A

A small amount of water is introduced to a mixing tank in advance, and the constitutional compounds are successively added thereto with stirring.

Method B

The powders of the constitutional compounds are mixed in advance, and the mixture is added into a small amount of water in a mixing tank at a stretch.

Method C

The constitutional compounds are in advance divided to two or more groups comprising those which can be combined conveniently, and each group is dissolved in water or a hydrophilic mixed solvent to make a concentrated solution, and these concentrated solutions are mixed. Producing methods partially combining each of these groups may be used.

In the present invention, the development step by a color developing solution prepared from the developer composition of the present invention is followed by the desilvering step, where the processes with a bleaching solution and a blixing solution are performed. When the photographic material is a color print material, the processing solution may also contain the above-described appropriate fluorescent brightening agents, preferably stilbene-based fluorescent brightening agents.

As the bleaching agents for use in a bleaching or blixing solution, well-known bleaching agents can be used, in particular, organic complex salts of iron(III) (e.g., complex salts of aminopolycarboxylic acids), or organic acids such as citric acid, tartaric acid, and malic acid, persulfate, and hydrogen peroxide are preferably used.

Of these compounds, organic complex salts of iron(III) are particularly preferred from the viewpoint of rapid processing and environmental protection. The examples of aminopolycarboxylic acids and salts thereof useful for forming organic complex salts of iron(III) include biodegradable ethylenediaminedisuccinic acid (SS body), N-(2-carboxylatoethyl)-L-aspartic acid, β-alaninediacetic acid, methyliminodiacetic acid, in addition, ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, iminodiacetic acid, and glycol ether diaminetetraacetic acid. These compounds may be any form of sodium salts, potassium salts, lithium salts and ammonium salts. Of these compounds, ethylenediaminedisuccinic acid (SS body), N-(2-carboxylatoethyl)-L-aspartic acid, β-alaninediacetic acid, ethylenediaminetetraacetic acid, 1,3-diaminopropanetetraacetic acid, and methyliminodiacetic acid are preferred because iron(III) complex salts thereof are excellent in photographic characteristics. (In the above compounds, that described as "SS body" is a compound having two asymmetric carbon atoms and each of two has SS type absolute configuration.) These ferric ion complex salts may be used in the form of complex salt, or ferric ion complex salts may be formed in a solution using ferric salts, e.g., ferric sulfate, ferric chloride, ferric nitrate, ferric ammonium sulfate and ferric phosphate with a chelating agent such as amino polycarboxylic acid. A chelating agent may be used in the excess amount more than the amount for forming ferric ion complex salt. Of the iron complexes, aminopolycarboxylic acid iron complex is preferred, and the addition amount thereof is from 0.01 to 1.0 mol/liter, preferably from 0.05 to 0.50 mol/liter, still more preferably from 0.10 to 0.50 mol/liter, and most preferably from 0.15 to 0.40 mol/liter.

The bleaching time is generally from 30 seconds to 6 minutes and 30 seconds, preferably from 1 minute to 4 minutes and 30 seconds, and the bleaching time of a color print material is from 30 seconds to 2 minutes.

It is preferred that a bleaching solution, a blixing solution or a fixing solution contain various well-known organic acids (e.g., glycolic acid, succinic acid, maleic acid, malonic acid, citric acid, sulfosuccinic acid), organic bases (e.g., imidazole, dimethylimidazole), or a compound represented by formula (A-a) disclosed in JP-A-9-211819 such as 2-picolic acid, and a compound represented by formula (B-b) disclosed in the same patent such as kojic acid. The addition amount of these compounds is preferably from 0.005 to 3.0 mol, more preferably from 0.05 to 1.5 mol, per liter of the processing solution.

Various well-known fixing agents are used in the blixing solution or the fixing solution in the present invention. The examples include thiosulfates such as sodium thiosulfate and ammonium thiosulfate, thiocyanates such as sodium thiocyanate and ammonium thiocyanate, thioether compounds such as ethylenebisthioglycolic acid and 3,6-dithia-1,8-octanediol, and water-soluble silver halide solvents such as thioureas. These compounds can be used alone or in combination of two or more. Further, the specific blixing solution comprising combination of a fixing agent and halides such as a great amount of potassium iodide as disclosed in JP-A-55-155354 can also be used in the present invention. Thiosulfate, in particular, ammoniumthiosulfate, is preferably used in the present invention. The addition amount of a fixing agent is preferably from 0.3 to 2 mol, more preferably from 0.5 to 1.0 mol, per liter of the solution.

The blixing solution or the fixing solution for use in the present invention preferably has pH of from 3 to 8, more preferably from 4 to 7. When the pH is lower than this range, the solution is deteriorated and cyan dyes becomes leuco dyes acceleratedly, although desilvering property is improved. While when the pH is higher than this range, desilvering is delayed and stains are liable to occur.

The bleaching solution for use in the present invention has pH of 8 or less, preferably from 2 to 7, and particularly preferably from 2 to 6. When the pH is lower than this range, the solution is deteriorated and cyan dyes becomes leuco dyes acceleratedly, while when the pH is higher than this range, desilvering is delayed and stains are liable to occur.

For adjusting pH, if necessary, hydrochloric acid, sulfuric acid, nitric acid, bicarbonate, ammonia, potassium hydroxide, sodium hydroxide, sodium carbonate, and potassium carbonate can be added to the solution.

Further, the blixing solution of the present invention can contain other various kinds of fluorescent brightening agents, defoaming agents, surfactants, and organic solvents such as polyvinyl pyrrolidone and methanol.

It is preferred that the blixing solution and the fixing solution in the present invention contain, as a preservative, sulfite ion-releasing compounds such as sulfite (e.g., sodium sulfite, potassium sulfite, ammonium sulfite, etc.), bisulfite (e.g., ammonium bisulfite, sodium bisulfite, potassium bisulfite, etc.), and metabisulfite (e.g., potassium metabisulfite, sodium metabisulfite, ammonium metabisulfite, etc.), and arylsulfinic acids such as p-toluenesulfinic acid and m-carboxybenzenesulfinic acid. The content of these compounds is preferably from about 0.02 to about 1.0 mol/liter in terms of a sulfite ion or sulfinate ion.

In addition to the above compounds, ascorbic acid, bisulfite adducts of carbonyl and carbonyl compounds can be used as a preservative.

Further, a buffer, a fluorescent brightening agent, a chelating agent, a defoaming agent, and an antimold can be used, if necessary.

The blixing processing time according to the present invention is from 5 to 240 seconds, preferably from 10 to 60 seconds, and the processing temperature is from 25° C. to 60° C., preferably from 30° C. to 50° C. The replenishing rate is from 20 to 250 ml, preferably from 30 to 100 ml, and particularly preferably from 15 to 60 ml, per $m^2$ of the photographic material.

The photographic material of the present invention is generally subjected to washing step and/or stabilizing step after desilvering step such as fixing or blixing.

The amount of washing water in the washing step can be selected from a wide range according to the characteristics (e.g., by the materials used such as couplers, etc.) and the application of the photographic materials, the temperature of washing water, the number of washing tanks (the number of washing stages), and other various conditions. Of the foregoing conditions, the relationship between the number of washing tanks and the amount of water in a multistage countercurrent system can be obtained by the method described in *Journal of the Society of Motion Picture and Television Engineers*, Vol. 64, pp. 248 to 253 (May, 1955). The number of stages in a multistage countercurrent system is generally preferably from 3 to 15, particularly preferably from 3 to 10.

According to the multistage countercurrent system, the amount of the washing water can be greatly reduced, however, problems arise that bacteria proliferate due to the increased residence time of the water in the tanks, and suspended matters produced thereby adhere to the photographic material. The method of reducing the calcium ion and magnesium ion concentrations as disclosed in JP-A-62-288838 can be used as a very effective means for overcoming these problems. Also, the isothiazolone compounds and the thiabendazoles as disclosed in JP-A-57-8542, the chlorine-based antibacterial agents such as chlorinated sodium isocyanurate as disclosed in JP-A-61-120145, the benzotriazole and copper ions as disclosed in JP-A-61-267761, and the antibacterial agents described in Hiroshi Horiguchi, *Bohkin Bohbai no Kagaku* (*Antibacterial and Antifungal Chemistry*), published by Sankyo Shuppan Co., Ltd. (1986), edited by Eisei Gijutsukai, *Biseibutsuno Mekkin, Sakkin, Bohbai Gijutsu* (*Germicidal and Antifungal Techniques of Microorganisms*), published by Kogyo Gijutsukai (1982), and edited by Nippon Bohkin Bohbai Gakkai, *Bohkin Bohbai Zai Jiten* (*Antibacterial and Antifungal Agents Thesaurus*) (1986), can be used.

According to the multistage countercurrent washing system, the amount of the washing water can be greatly reduced to the level equal to the stabilizing solution so far been used, thus this is sometimes called a water-washing substitution stabilizing solution. For stabilizing images, stabilizing solutions so far been used are also used in some cases. Accordingly, washing step is performed by combining one or more systems of a conventional water-washing system, a water-washing substitution stabilizing solution system and an image-stabilizing solution system.

Processing by the stabilizing solution follows the water-washing step or may be performed directly without being subjected to washing step. Compounds having the function of image stabilization, e.g., aldehyde compounds represented by formalin, buffers for adjusting film p.H to be suitable for dye stabilization, and ammonium compounds, are added to the stabilizing solution. In particular, aldehydes such as formaldehyde, acetaldehyde and pyruvic aldehyde which inactivate the residual magenta couplers and prevent the discoloration of the dyes and the generation of stains, the methylol compounds and hexamethylenetetramine disclosed in U.S. Pat. No. 4,786,583, the hexahydrotriazine disclosed in JF-A-2-153348, the bisulfite adducts of formaldehyde disclosed in U.S. Pat. No. 4,921,779, and the azolylmethylamines disclosed in EP 504609 and EP 519190 are added to the stabilizing solution However, any of the above washing water and stabilizing solutions has a water washing function, and they substantially have the same function except that an image stabilizer is added or not, thus they will be described collectively below.

A surfactant as a dewatering agent and a chelating agent represented by EDTA as a water softener can further be added to a stabilizing solution and washing water. Further, a fluorescent brightening agent and a hardening agent can further be added to a stabilizing solution and washing water. In the process of the photographic material of the present invention, when the photographic material is directly processed with a stabilizing solution without subjecting to the washing step, any of the well-known methods disclosed in JP-A-57-8543, JP-A-58-14834 and JP-A-60-220345 can be used.

In addition, it is also preferred to use a chelating agent such as 1-hydroxyethylidene-1,1-diphosphonic acid and ethylenediaminetetramethylenephcsphonic acid, and magnesium compounds and bismuth compounds.

The pH of the water washing step and the stabilizing step is preferably from 4 to 10, more Preferably from 5 to 8. The temperature can be set up according to various uses and characteristics of the photographic material but is generally from 20 to 50° C., preferably from 25 to 45° C.

Drying step is performed following washing and/or stabilizing step(s). It is possible to expedite drying by absorbing water of the material fresh from the washing tank by means of a squeegee and cloth from the viewpoint of reducing the carryover of water to the image film. As the improving means from the drier side, although it is a matter of course, drying can be expedited by increasing temperature and modulating the shape of blowing nozzles to strengthen the dry air. Further, as is disclosed in JP-A-3-157650, the adjustment of the angle of air blowing to the photographic material and discharging method so the exhaust air are also effective to speed up drying.

In the next place, the photographic materials to which the liquid processing composition in the present invention is applied are described.

As described above in concerning with the object and the background of the present invention, the photographic materials using the liquid processing composition in the present invention are color photographic materials for photographing, color photographic papers, black-and-white photographic materials for photographing, and black-and-white photographic papers which are generally used in the photographic market. These photographic materials comprise at least one light-sensitive layer on a support. As a typical example, the silver halide photographic material of the present invention comprises at least one light-sensitive layer consisting of a plurality of silver halide emulsion layers having substantially the same spectral sensitivity but different degrees of sensitivity on a support.

In the multilayer silver halide color photographic material for photographing, the light-sensitive layer is a unit light-sensitive layer having spectral sensitivity to any of blue light, green light and red light, and these unit light-sensitive Layers are generally arranged in the order of red-sensitive layer, green-sensitive layer and blue-sensitive layer from the support side. However, the order of arrangement can be reversed depending on the purpose, alternatively, the light-sensitive layers may be arranged in such a way that a layer having different spectral sensitivity is interposed between layers having the same spectral sensitivity. Light-insensitive layers may be provided between he above silver halide light-sensitive layers, and on the uppermost layer and beneath the lowermost layer of the silver halide light-sensitive layers. These light-insensitive layers may contain couplers, DIR compounds and color mixing preventives described later. As the plurality of silver halide emulsion layers constituting each unit light-sensitive layer, it is preferred to use a two-layer structure of a high sensitivity emulsion layer and a low sensitivity emulsion layer with the emulsion layers being arranged so as to decrease in sensitivity toward the support in turn as disclosed in German Patent 1,121,470 and British Patent 923,045. Moreover, a low sensitivity emulsion layer may be provided farther from the support and a high sensitivity emulsion layer nay he provided nearer to the support as disclosed in JP-A-57-112751, JP-A-62-200350, JP-A-62-206541 and JP-A-62-206543.

In one specific example, a low sensitivity blue-sensitive layer (BL)/a high sensitivity blue-sensitive layer (BH)/a high sensitivity green-sensitive layer (GH)/a low sensitivity green-sensitive layer (GL)/a high sensitivity red-sensitive layer (RH) /a low sensitivity red-sensitive layer (RL), or BH/BL/GL/GH/RH/RL, or BH/BL/GH/GL/RL/RH can be arranged in -his order from the side farthest from the support.

A blue-sensitive layer/GH/RH/GL/RL can be arranged in this order from the side farthest from he support as disclosed in JP-B-55-34932. Further, a blue-sensitive layer/GL/RL/GH/RH can be arranged in this order from the side farthest from the support as disclosed in JF-A-56-25738 and JP-A-62-63936.

Further, useful arrangements include the arrangement in which there are three layers having different degrees of sensitivities with the sensitivity being lower towards the support such that the uppermost layer is a silver halide emulsion layer having the highest sensitivity, the middle layer is a silver halide emulsion layer having a lower sensitivity than that of the uppermost layer, and the lowermost layer is a silver halide emulsion layer having a lower sensitivity than that of the middle layer, as disclosed in JP-B-49-15495. In the case of the structure of this type comprising three layers having different degrees of sensitivities, the layers in the unit layer of the same spectral sensitivity may be arranged in the order of a middle sensitivity emulsion layer/a high sensitivity emulsion layer/a low sensitivity emulsion layer from the side farthest from the support, as disclosed in JP-A-59-202464.

Alternatively, the layers can be arranged in the order of a high sensitivity emulsion layer/a low sensitivity emulsion layer/a middle sensitivity emulsion layer, or a low sensitivity emulsion layer/a middle sensitivity emulsion layer/a high sensitivity emulsion layer. Moreover, the arrangement may be varied as indicated above in the case where there are four or more layers.

For improving color reproducibility, a donor layer (CL) for an interlayer effect having a different spectral sensitivity distribution from a main light-sensitive layer such as BL, GL and RL may preferably be provided contiguous or close to the main light-sensitive layer, as disclosed in U.S. Pat. Nos. 4,663,271, 4,705,744, 4,707,436, JP-A-62-160448 and JP-A-63-89850.

The silver halides preferably used in the materials for photographing are silver iodobromide, silver iodochloride or silver iodochlorobromide containing about 30 mol % or less of silver iodide, and particularly preferably used silver halides are silver iodobromide or silver iodochlorobromide containing from about 2 mol % to about 10 mol % of silver iodide.

Silver halide grains in a photographic emulsion may have a regular crystal form such as a cubic, octahedral or tetradecahedral form, an irregular crystal form such as a spherical or plate-like form, a form which has crystal defects such as twin crystal planes, or a form which is a composite of these forms.

Silver halide grains are used in a wide range since the silver halide grains having a grain size suitable for each light-sensitive layer are prepared, e.g., fine size grains having a projected area diameter of from 0.1 to 0.2 $\mu$m, or large size grains of from 1.0 up to 10 $\mu$m are used, and the emulsions may be a polydispersed emulsion or a monodispersed emulsion.

It is preferred to use light-insensitive fine grained silver halides in color photographic materials. Light-insensitive fine grained silver halides are fine grained silver halides which are not sensitive to light upon imagewise exposure for obtaining color images and do not substantially undergo development during development processing, and they are preferably not pre-fogged. Fine grained silver halides have a silver bromide content of from 0 to 100 mol %, and may contain silver chloride and/or silver iodide, if necessary. Fine grained silver halides which have a silver iodide content of from 0.5 to 10 mol % are preferred. The average grain size of fine grained silver halides (the average value of the equivalent-circle diameters of the projected area diameter) is preferably from 0.01 to 0.5 $\mu$m, more preferably from 0.02 to 0.2 $\mu$m.

Fine grained silver halide can be prepared by the same methods as the preparation of generally used light-sensitive silver halides. In the preparation of fine grained silver halide, the surface of the silver halide grains does not need to be optically sensitized and also does not need to be spectrally sensitized. However, it is preferred to add known stabilizers such as triazole based-, azaindene based-, benzothiazolium based-, or mercapto based-compounds, or zinc compounds to the fine grained silver halide in advance before addition to the coating solution. Colloidal silver can be contained in the layer containing the fine grained silver halide grains.

The coating weight of silver in the color photographic material to which the processing agent in the present invention is applied is preferably 6.0 g/m$^2$ or less, and most preferably 4.5 g/m$^2$ or less.

The color photographic material using the processing agent according to the present invention has a total film thickness of all the hydrophilic colloid layers on the side where the emulsion layers are located of preferably 28 $\mu$m or less, more preferably 23 $\mu$m or less, still more preferably 18 $\mu$m or less, and most preferably 16 $\mu$m or less. Further, the film swelling rate $T_{1/2}$, is preferably 30 seconds or less, more preferably 20 seconds or less. $T_{1/2}$ is defined as the time required for the film thickness to reach ½ of the saturated film thickness, taking 90% of the maximum swollen film thickness reached when being processed at 30° C. for 3 minutes and 15 seconds in a color developing solution as the saturated film thickness. The film thickness means the film thickness measured under conditions of 25° C., 55% RH (stored for two days), and $T_{1/2}$ can be measured using a swellometer of the type described in A. Green et al., *Photogr. Sci. Eng.*, Vol. 19, No. 2, pp. 124 to 129. $T_{1/2}$, can be adjusted by adding hardening agents to gelatin which is used as a binder, or by changing the aging conditions after coatings. Further, a swelling factor of from 150% to 400% is preferred. The swelling factor can be calculated from the maximum swollen film thickness obtained under the conditions described above using the equation: (maximum swollen film thickness film thickness)/film thickness.

On the other hand, silver halide grains contained in a photographic emulsion preferably used in forming a print may have a regular crystal form such as a cubic, tetradecahedral or octahedral form or an irregular crystal form such as a spherical or plate-like form, or a form which is a composite of these forms.

A pair of parallel planes vertical to the thickness direction of a tabular grain is called main planes. In the present invention, a photographic emulsion containing tabular grains having {111} planes as the main planes or {100} planes as the main planes is preferably used.

With respect to (111) tabular grains, various methods of using crystal phase controlling agents are disclosed, e.g., the compounds disclosed in JP-A-2-32 (Exemplified Compounds 1 to 42) are preferably used.

High silver chloride grains means the grains having silver chloride content of 80 mol % or more, and grams having silver chloride content of 95 mol % or more are preferred. The silver halide grains for use in the present invention preferably have core/shell structure comprising a core part and a shell part surrounding the core part. It is preferred that silver chloride accounts for 90 mol % or more of the core part. The core cart may comprise two or more parts having different halogen compositions. It is preferred that the shell part accounts for 50% or less of the entire grain volume, particularly preferably 20% or less. The shell part preferably comprises silver iodochloride or silver iodobromochloride. The shell part preferably contains from 0.5 to 13 mol % of iodide, particularly preferably from 1 to 13 mol %. The content of silver iodide in the entire grain is preferably 5 mol % or less, particularly preferably 1 mol % or less.

It is preferred that silver bromide is contained in higher concentration: in the shell part than in the core part. The content of silver bromide is preferably 20 mol % or less, particularly preferably 5 mol % or less.

The average grain size (the equivalent-sphere diameter in terms of volume) of the silver halide grains for use in the photographic material for photographic paper is not particularly restricted but is preferably from 0.1 to 0.8 $\mu$m, particularly preferably from 0.1 to 0.6 $\mu$m. The equivalent-circle diameter of a tabular grain is preferably from 0.2 to 1.0 $\mu$m. The diameter of a silver halide grain used in the present invention is the diameter of a circle having the same area with the projected area of the grain in an electron microphotograph. The thickness of a tabular grain in tie present invention is 0.2 $\mu$m or less, preferably 0.15 $\mu$m or less, and particularly preferably: 0.12 $\mu$m or less. The grain size distribution of the silver halide grains in the present invention may be polydispersion or monodispersion but monodispersed grains are preferred. In particular, the variation coefficient of the equivalent-circle diameter of the tabular grains accounting for 50% or more of the entire projected area is preferably 20% or less, ideally 0%.

Color photographic materials for photographing and for manufacturing a print are described below. The silver halide photographic emulsions for use in the present invention can be prepared using he methods described, e.g., in *Research Disclosure* (hereinafter abbreviated to RD), No.17643 (December, 1978), pp. 22 and 23, "I. Emulsion Preparation and Types", RD, No.18716 (November, 1979) , p. 648, RD, No.307105 (November, 1989), pp. 863 to 865, P. Glafkides, *Chimie et Physique Photographigue*, Paul Montel (1967), G. F. Duffin, *Photographic Emulsion Chemistry*, Focal Press (1966), and V. L. Zelikman et al., *Making and Coating Photographic Emulsion*, Focal Press (1964).

The monodispersed emulsions disclosed in U.S. Pat. Nos. 3,574,628, 3,655,394 and British Patent 1,413,748 are also preferably used.

Further, tabular grains having an aspect ratio of about 3 or more can also be used in the present invention. Tabular grains can be easily prepared according to the methods described, e.g., in Gutoff, *Photographic Science and Engineering*, Vol. 14, pp. 248 to 257 (1970), U.S. Pat. Nos. 4,434,226, 4,414,310, 4,433,048, 4,439,520 and British Patent 2,112,157.

The crystal structure may be uniform, or the interior and exterior parts of the grains may be comprised of different halogen compositions, or the grains may have a layered structure. Silver halides which have different compositions may be joined with an epitaxial junction or may be joined with compounds other than a silver halide, such as silver thiocyanate or lead oxide. Further, mixtures of grains which have various crystal forms may also be used.

The above described emulsions may be of the surface latent image type wherein the latent image is primarily formed on the surface, or of the internal latent image type wherein the latent image is formed within the grains, or of a type wherein the latent image is formed both on the surface and within the grains, but a negative type emulsion is essential. Of the internal latent image types, the emulsion may be a core/shell type internal latent image type emulsion as disclosed in JP-A-63-264740, and a method for preparation of such a core/shell type internal latent image type emulsion is disclosed in JP-A-59-133542. The thickness of the shell of this emulsion varies depending upon the development process, but is preferably from 3 to 40 nm, and particularly preferably from 5 to 20 nm.

The silver halide emulsion for use in the present invention is usually subjected to physical ripening, chemical ripening and spectral sensitization. Additives for use in, such processes are disclosed in RD, No. 17643, RD, No. 18716, and RD, No. 307105, and the locations of these disclosures are summarized in a table below.

In the color photographic material using the processing agent according to the present invention, two or more different types of emulsions which are different in terms of at least one of the characteristics of grain size, grain size distribution, halogen composition, the form of the grains, and light sensitivity of the light-sensitive silver halide emulsion can be used in admixture in the same layer.

It is preferred to use the silver halide grains having a fogged grain surface as disclosed in U.S. Pat. No. 4,082,553, the silver halide grains having a fogged grain interior as disclosed in U.S. Pat. No. 4,626,498 and JP-A-59-214852, or colloidal silver in light-sensitive silver halide emulsion layers and/or substantially light-insensitive hydrophilic colloid layers. Silver halide grains having a fogged grain interior or surface are silver halide grains which can be developed uniformly (not imagewise) irrespective of whether these grains are in an unexposed area or an exposed area of the photographic material, and methods for the preparation of such silver halide grains are disclosed in U.S. Pat. No. 4,626,498 and JP-A-59-214852. The silver halide which forms the internal nuclei of core/shell type silver halide grains having a fogged grain interior may have different halogen compositions. The silver halide having a fogged grain interior or surface may be any of silver chloride, silver chlorobromide, silver iodobromide, or silver chloroiodobromide.

The photographic additives which can be used in a color photographic material are also described in RD's and the locations related thereto are indicated in the following table.

| Type of Additives | RD 17643 | RD 18716 | RD 307105 |
|---|---|---|---|
| 1. Chemical Sensitizers | page 23 | page 648, right column | page 866 |
| 2. Sensitivity Increasing Agents | — | page 648, right column | — |
| 3. Spectral Sensitizers and Supersensitizers | pages 23–24 | page 648, right column to page 649, right column | pages 866–868 |
| 4. Brightening Agents | page 24 | page 647, right column | page 868 |
| 5. Light Absorbers, Filter Dyes, and Ultraviolet Absorbers | pages 25–26 | page 649, right column to page 650, left column | page 873 |
| 6. Binders | page 26 | page 651, left column | pages 873–874 |
| 7. Plasticizers and Lubricants | page 27 | page 650, right column | page 876 |
| 8. Coating Aids and Surfactants | pages 26–27 | page 650, right column | pages 875–876 |
| 9. Antistatic Agents | page 27 | page 650, right column | pages 876–877 |
| 10. Matting Agents | — | — | pages 878–879 |

Various dye-forming couplers can be used in the color photographic material, and the following couplers are particularly preferred.

Yellow Couplers:

The couplers represented by formula (I) or (II) disclosed in EP-A-502424; the couplers represented by formula (1) or (2) disclosed in EP-A-513496 (in particular, Y-28 on page 18); the couplers represented by formula (I) disclosed in claim 1 of EP-A-568037; the couplers represented by formula (I), column 1, lines 45 to 55 of U.S. Pat. No. 5,066,576; the couplers represented by formula (I) , paragraph [0008] of JP-A-4-274425; the couplers disclosed in claim 1 on page 40 of EP-A-498361 (in particular, D-35 on page 18); the couplers represented by formula (Y) on page 4 of EP-A-447969 (in particular, Y-1 (page 17) and Y-54 (page 41)); and the couplers represented by any of formulae (II to (IV), lines 36 to 58, column 7 of U.S. Pat. No. 4,476,219 (in particular, II-17 and II-19 (column 17), and II-24 (column 19)).

Magenta Couplers:

L-57 (page 11, right lower column), L-68 (page 12, right lower column), and L-77 (page 13, right lower column) of JP-A-3-39737; [A-4]-63 (page 134), and [?-4]-73 and [A-4]-73 (page 139) of EP-A-456257; M-4 and M-6 page 26) and M-7 (page 27) of EP-486965; M-45 (page 19) of EP-A-571959; (M-1) (page 6) of JP-A-5-204106; and M-22, paragraph [0237] of JP-A-4-362631.

Cyan Couplers:

CX-1, CX-3, CX-4, CX-5, CX-11, CX-12, CX-14 and CX-15 (pages 14 to 16) of JP-R-4-204843; C-7 and C-10 (page 35), C-34 and C-35 (page 37), and (I-1) and (I-17) (pages 42 and 43) of JP-A-4-43345; and the couplers represented by formula (Ia) or (Ib) disclosed in claim 1 of JP-A-6-67385.

Polymer Couplers:

P-1 and P-5 (page 11) of JP-A-2-44345.

Couplers the Colored Dyes of Which Have an Appropriate Diffusibility:

The couplers disclosed in U.S. Pat. No. 4,366,237, British Patent 2,125,570, EP-B-96873 and German Patent 3,234,533 are preferred as the couplers the colored dyes of which have an appropriate diffusibility.

Couplers for Correcting the Unnecessary Absorption of Colored Dyes:

Examples of preferred couplers for correcting the unnecessary absorption of colored dyes include the yellow colored cyan couplers represented by formula (CI), (CII), (CIII) or (CIV) disclosed on page 5 of EP-A-456257 (in particular, YC-,6 on page 84); the yellow colored magenta couplers EX M-7 (page 202), EX-1 (page 249), and EX-7 (page 251) disclosed in EP-A-456257; the magenta colored cyan couplers CC-9 (column 8) and CC-13 (column 10) disclosed in U.S. Pat. No. 4,833,069; the coupler (2) (column 8) of U.S. Pat. No. 4,837,136; and the colorless masking couplers represented by formula (A) disclosed in claim 1 of WO 92/11575 (in particular, the exemplified compounds disclosed on pages 36 to 45).

Examples of compounds which release photographically useful groups include the following:

Development Inhibitor-releasing Compounds:

the compounds represented by formula (I), (II), (III) or (IV) disclosed on page 11 of EP-A-378236;

Bleaching Accelerator-releasing Compounds:

the compounds: represented by formula (I) or (I') disclosed on page 5 of EP-A-310125;

Ligand-releasing Compounds:

the compounds represented by LIG-X disclosed in claim 1 of U.S. Pat. No. 4,555,478;

Leuco Dye-releasing Compounds:

Compounds 1 to 6, columns 3to 8 of U.S. Pat. No. 4,749,641;

Fluorescent Dye-releasing Compounds:

the compounds disclosed in claim 1 of U.S. Pat. No. 4,774,181;

Development Accelerator-releasing or Fogging Agent-releasing Compounds:

the compounds represented by formula (1), (2) or (3), column 3 of U.S. Pat. No. 4,656,123; and Compounds Which Release Dyes the Color of Which is Restored After Elimination:

the compounds represented by formula (I) disclosed in claim 1 of U.S. Pat. No. 4,857,447.

Preferred additives other than couplers are well-known dispersion mediums of oil-soluble organic compounds, latexes for impregnation of oil-soluble organic compounds, scavengers for the oxidation products of developing agents, stain inhibitors, discoloration inhibitors, hardening agents, development inhibitor precursors, stabilizers, antifoggants, chemical sensitizers, dyes, crystallite dispersions of dyes, and ultraviolet absorbers.

The present invention can be applied to processing of various color photographic materials such as color negative films for general and cinematographic uses, color reversal films for slide and television uses, color photographic papers, and color positive films. The present invention can also preferably be applied to the film units equipped with lenses as disclosed in JP-B-2-32615 and JP-B-U-3-39784 (the term "JP-B-U" as used herein means an "examined Japanese utility model publication").

Suitable supports which can be preferably used for color photographic materials to which the processing agent of the present invention is applied are disclosed, for example, in RD, No. 17643, page 28, RD, No. 18716, from page 647, right column to page 648, left column, and RD, No. 307105, page 879.

In the color photographic material to which the processing agent of the present invention is applied, it is preferred to provide hydrophilic colloid layers (known as backing layers) having a total dry film thickness of from 2 $\mu$m to 20 $\mu$m on the side of the support opposite to the side on which emulsion layers are provided. It is preferred for the backing layer to contain the above described light absorbing agents, filter dyes, ultraviolet absorbers, antistatic agents, hardening agents, binders, plasticizers, lubricants, coating aids, and surfactants. The swelling factor of the backing layer is preferably from 150 to 500%.

The color photographic material to which the processing agent of the present invention is applied has a magnetic recording layer in many cases. The magnetic recording layer is a layer coated on a support with an aqueous or organic solvent-based coating solution comprising magnetic particles dispersed in a binder. The photographic materials to which the processing and the processing agent of the present invention are applied are disclosed in JP-A-2001-92090, paragraphs [0162] to [0166].

A reflective support is used in color photographic paper for color print. As the reflective support, a reflective support, which is laminated with a plurality of polyethylene layers and polyester layers and at least one of such water resistant resin layers (laminated layers) contains a white pigment, e.g., titanium oxide, is preferred.

Further, it is preferred that the above water resistant resin layers contain a fluorescent brightening agent. The fluorescent brightening agent may be dispersed in a hydrophilic colloid layer of the photographic material. The preferred fluorescent brightening agents are benzoxazole-based, coumarin-based, and pyrazoline-based fluorescent brightening agents, and benzoxazolylnaphthalene-based and benzoxazolylstilbene-based fluorescent brightening agents are more preferred. The addition amount of the fluorescent brightening agents is not particularly limited but is preferably from 1 to 100 mg/m$^2$. The mixing ratio when they are mixed with a water resistant resin is preferably from 0.0005 to 3 wt %, more preferably from 0.001 to 0.5 wt %, to the resin.

A transmitting type support and the above-described reflective type support coated with hydrophilic colloid layer containing a white pigment may also be used as the reflective type support.

A reflective type support having a mirror reflective property or second kind diffuse reflective metal surface may also be used.

A cellulose triacetate support and a polyester support are used for a color photographic material for photographing, and the details thereof are described in *Kokai-Giho*, Kogi No. 94-6023 (Hatsumei-Kyokai, Mar. 15, 1994).

Polyester is formed with diol and aromatic dicarboxylic acid as essential components, and the examples of the aromatic dicarboxylic acids include 2,6-, 1,5-, 1,4- and 2,7-naphthalenedicarboxylic acid, terephthalic acid, isophthalic acid, and phthalic acid, and the examples of the diols include diethylene glycol, triethylene glycol, cyclohexanedimethanol, bisphenol A, and bisphenol. Polymerized polymers thereof include homopolymers such as polyethylene terephthalate, polyethylene naphthalate, polycyclohexanedimethanol terephthalate and the like. Polyester containing from 50 mol % to 100 mol % of 2,6-naphthalenedicarboxylic acid is particularly preferred. Polyethylene 2,6-naphthalate is preferred above all. The average molecular weight of polyester is about 5,000 to 200,000. Tg of the polyester for use in the present invention is 50° C. or more, and 90° C. or more is preferred.

An ultraviolet absorber may be incorporated into the polyester support. Further, light piping can be prevented by incorporating the commercially available dye or pigment for polyester such as Diaresin manufactured by Mitsubishi Kasei Corp. or Kayaset manufactured by Nippon Kayaku Co., Ltd. into polyester.

To ensure adhesion of the support and the constitutional layers of the photographic material using the processing agent in the present invention, the surface activation treatment is preferably performed after coating an undercoat layer or directly on the surface, such as chemical treatment, mechanical treatment, corona discharge treatment, flame treatment, ultraviolet treatment, high frequency treatment, glow discharge treatment, active plasma treatment, laser treatment, mixed acid treatment, and ozone oxidation treatment, and preferred surface activation treatments are ultraviolet irradiation treatment, flame treatment, corona discharge treatment, and glow discharge treatment.

Further, antistatic agents are preferably used in the photographic material using the processing agent according to the present invention. The examples of such antistatic agents include high polymers containing carboxylic acid and carboxylate, sulfonate, cationic polymer, and ionic surfactant compounds.

The most preferred antistatic agents are fine particles of a crystalline metallic oxide of at least one particle selected from zinc oxide, silicon dioxide, titanium dioxide, alumina, indium oxide, magnesium oxide, barium oxide, manganese oxide, and vanadium oxide having a volume resistivity of $10^7\Omega\cdot$cm or less, more preferably $10^5\Omega\cdot$cm or less, and having a particle size of from 0.001 to 1.0 $\mu$m, or fine particles of composite oxides of them (Sb, P, B, In, S, Si, C), further, fine particles of a metallic oxide in the form of sol or fine particles of these composite oxides. The addition amount to the photographic material is preferably from 5 to 500 mg/m$^2$ and particularly preferably from 10 to 350 mg/m$^2$. The ratio of the conductive crystalline oxides or composite oxides thereof to the binder is preferably from 1/300 to 100/1 and more Preferably from 1/100 to 100/5.

It is preferred for the color photographic material of the present invention to have a sliding property. The sliding agent-containing layer is preferably provided on both of light-sensitive layer surface and backing layer surface. Preferred sliding property is a dynamic friction coefficient of from 0.25 to 0.01. Measurement at this time is performed using a stainless steel ball having a diameter of 5 mm at a conveying speed of 60 cm/min (25° C., 60% RH). In this evaluation, when the opposite material is replaced with the light-sensitive layer surface, almost the same level of value can be obtained.

The examples of the sliding agent which can be used in the present invention include polyorganosiloxane, higher fatty acid amide, higher fatty acid metal salt, higher resin acid and higher alcohol ester. As polyorganosiloxane, polydimethylsiloxane, polydiethylsiloxane, polystyrylmethylsiloxane, and polymethylphenylsiloxane can be used. The sliding agent is preferably added to the outermost layer of an emulsion layer or a backing layer. In particular, polydimethylsiloxane and esters having a long chain alkyl group are preferred.

The color photographic material preferably contains a matting agent. The matting agent may be added to either of the emulsion layer side or the backing layer side but it is particularly preferably added to the outermost layer of the emulsion layer side. The matting agent may be either soluble or insoluble in the processing solution, Preferably both types are used in combination. For example, polmethylmethacrylate, poly(methyl methacrylate/methacrylic acid=9/1 or 5/5 (mol ratio)), and polystyrene particles are preferably used. The particle size is preferably from 0.8 to 10 $\mu$m, and the particle size distribution is preferably narrow, preferably particles having particle sizes of from 0.9 to 1.1 times the average particle size account for 90% or more of the entire particle number. For improving the matting property, fine particles having a particle size of 0.8 $\mu$m or less are preferably added at the same time. For example, polymethylmethacrylate (0.2 $\mu$m)), poly(methyl methacrylate/methacrylic acid=9/1 (mol ratio), 0.3 $\mu$m), polystyrene particles (0.25 $\mu$m), and colloidal silica (0.03 $\mu$m) are enumerated.

The present invention will be described in retail with reference to the examples below, but these are not to be construed as limiting the present invention.

EXAMPLE 1

1. Preparation of Photographic Material for Test

[Support]

The photographic material used for the test in Example 1 (hereinafter referred to as "sample film") was prepared according to the following method.

1) First Layer and Undercoating Layer

Both surfaces of a polyethylene naphthalate support having a thickness of 90 $\mu$m were subjected to glow discharge treatment at treatment atmospheric pressure of 2.66×10 Pa, $H_2O$ partial pressure in the atmospheric gas of 75%, discharge frequency of 30 kHz, output of 2,500 W, and treatment intensity of 0.5 kV·A·min/m$^2$. As the first layer, a coating solution having the composition shown below was coated on the support in a coating amount of 5 ml/m$^2$ by the bar coating method disclosed in JP-B58-4589.

| | |
|---|---|
| Dispersion solution of electrically conductive fine particles (water dispersion solution of $SnO_2/Sb_2O_5$ in particle concentration of 10%, primary particle size: 0.005 $\mu$m, average particle size of secondary agglomerate: 0.05 $\mu$m) | 50 mass parts |
| Gelatin | 0.5 mass parts |
| Water | 49 mass parts |
| Polyglycerol polyglycidyl ether | 0.16 mass parts |
| Polyoxyethylene sorbitan monolaurate (degree of polymerization: 20) | 0.1 mass parts |

After the first layer had been coated, the support was wound around a stainless steel core having a diameter of 20 cm and heat-treated at 110° C. (Tg of PEN support: 119° C.) for 48 hours to give the support heat hysteresis. After annealing treatment, an undercoating layer for an emulsion having the composition shown below was coated on the side of the support opposite to the side on which the first layer was coated in a coating amount of 10 ml/m$^2$ by a bar coating method.

| | |
|---|---|
| Gelatin | 1.01 mass parts |
| Salicylic acid | 0.30 mass parts |
| Resorcinol | 0.40 mass parts |
| Polyoxyethylene nonylphenyl ether (degree of polymerization: 10) | 0.11 mass parts |
| Water | 3.53 mass parts |
| Methanol | 84.57 mass parts |
| n-Propanol | 10.08 mass parts |

Further, the second layer and the third layer described later were coated on tie first layer in order, and in the last place a color negative photographic material having the composition described later was multilayer-coated on the opposite side, thus a transparent magnetic recording medium having a silver halide emulsion layer was obtained.

2) Second Layer (Transparent Magnetic Recording Laser)

(1) Dispersion of Magnetic Substance

Co-Adheredγ-$Fe_2O_3$magnetic substance (1,100mass parts) (average long axis length: 0.25 $\mu$m, $S_{BET}$: 39 m$^2$/g, Hc: 6.56×10$^6$ A/m, σs: 77.1 Am$^2$/kg, σr: 37.4 Am$^2$/kg), 220 mass parts of water, and 165 mass parts of a silane coupling agent [3-(polyoxyethynyl)oxypropyl trimethoxysilane, degree of polymrerization: 10] were thoroughly kneaded by means of an open kneader for 3 hours. This coarsely dispersed viscous solution was dried at 70° C. for a whole day and night to remove water, and then heat-treated at 110°

C. for 1 hour, thus the surface-treated magnetic particles were prepared.

Kneading of the magnetic particles was performed again by the following prescription with an open kneader for 4 hours.

| | |
|---|---|
| The above-obtained surface treated magnetic particles | 855 g |
| Diacetyl cellulose | 25.3 g |
| Methyl ethyl ketone | 136.3 g |
| Cyclohexanone | 136.3 g |

Further, fine dispersion of the above-kneaded magnetic particles was performed by the following prescription in a sand mill (sand mill: 1/4 G) at 2,000 rpm for 4 hours. Glass beads of 1 mm ϕ were used as the dispersing media.

| | |
|---|---|
| The above-kneaded solution | 45 g |
| Diacetyl cellulose | 23.7 g |
| Methyl ethyl ketone | 127.7 g |
| Cyclohexanone | 127.7 g |

An intermediate solution containing the magnetic substance was prepared by the following prescription.

(2) Preparation of Intermediate Solution Containing Magnetic Substance

| | |
|---|---|
| Fine dispersion solution of the above magnetic substance | 674 g |
| Diacetyl cellulose solution (solid Content: 4.34%, solvent: a 1/1 mixture of methyl ethyl ketone/cyclohexanone) | 24,280 g |
| Cyclohexanone | 46 g |

These components were mixed and stirred with a disper to prepare an intermediate solution containing the magnetic substance.

A dispersion solution of an α-alumina abrasive of the present invention was prepared by the following prescription. (a) Sumi corundum AA-1.5 (average primary particle size: 1.5 μm, specific surface area: 1.3 $m^2/g$)

Preparation of Dispersion Solution of Particles

| | |
|---|---|
| Sumi corundum AA-1.5 | 152 g |
| Silane coupling agent KBM903 (manufactured by Shin-Etsu Silicone Co., Ltd.) | 0.48 g |
| Diacetyl cellulose solution (solid content: 4.5%, solvent: a 1/1 mixture of methyl ethyl ketone/cyclohexanone) | 227.52 g |

Fine dispersion was performed by the above prescription in a ceramic-coated sand mill (sand mill: 1/4 G) at 800 rpm for 4 hours. Zirconia beads of 1 mm ϕ were used as the dispersing media.

(b) Colloidal silica particle dispersion solution (fine particles)

MEK-ST manufactured by Nissan Chemical Industries, Ltd. was used.

This was dispersion solution of colloidal silica having an average primary particle size of 0.015 μm, and methyl ethyl ketone was used as the dispersion medium. The solid content was 30%.

(3) Preparation of Second Layer Coating Solution

| | |
|---|---|
| The above-prepared intermediate solution containing the magnetic substance | 19,053 g |
| Diacetyl cellulose solution (solid content: 4.5%, solvent: a 1/1 mixture of methyl ethyl ketone/cyclohexanone) | 264 g |
| Colloidal silica dispersion solution (MEK-ST, dispersion solution (b), solid content: 30%) | 128 g |
| AA-1.5 dispersion solution (dispersion solution (a)) | 12 g |
| Millionate MR-400 dilution solution (manufactured by Nippon Polyurethane Co., Ltd.) (solid content: 20%, solvent for dilution: a 1/1 mixture of methyl ethyl ketane/cyclohexanone) | 203 g |
| Methyl ethyl ketone | 170 g |
| Cyclohexanone | 170 g |

A coating solution obtained by mixing and stirring the above components was coated on the support in a coating amount of 29.3 $ml/m^2$ by a wire bar coating method, and the coated second layer was dried at 110° C. The thickness of the magnetic layer after drying was 1.0 μm.

3) Third Layer (Layer Containing Higher Fatty Acid Ester Sliding Agent)

(1) Preparation of Stock Solution of Sliding Agent Dispersion

Solution (i) shown below was heated at 100° C. and dissolved and added to solution (ii) shown below, and the mixed solution was dispersed in a high pressure homogenizer to thereby obtain a stock solution of sliding agent dispersion.

| | |
|---|---|
| Solution (i) | |
| $C_6H_{13}CH(OH)(CH_2)_{10}COOC_{50}H_{101}$ | 399 mass parts |
| $n\text{-}C_{50}H_{101}O(CH_2CH_2O)_{16}H$ | 171 mass parts |
| Cyclohexanone | 830 mass parts |
| Solution (ii) | |
| Cyclohexanone | 8,600 mass parts |

(2) Preparation of Spherical Inorganic Particle Dispersion Solution

The dispersion solution of spherical inorganic particles (cl) was prepared according to the following prescription.

| | |
|---|---|
| Isopropyl alcohol | 93.54 mass parts |
| Silane coupling agent KBM903 (manufactured by Shin-Etsu Silicone Co., Ltd.) | 5.53 mass parts |
| Compound 1-1 ($(CH_3O)_3Si—(CH_2)_3—NH_2$) | |
| Compound 1 | 2.93 mass parts |

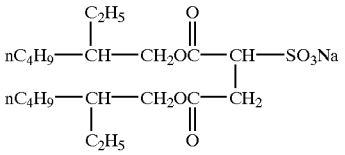

-continued

| | |
|---|---|
| C Hosta KEP50 (amorphous silica, average particle size: 0.5 μm, manufactured by Nippon Shokubai Co., Ltd.) | 88.00 mass parts |

The above components were stirred for 10 minutes, and then the following was further added.

| | |
|---|---|
| Diacetone alcohol | 252.93 mass parts |

The above mixed solution was dispersed for 3 hours in an ultrasonic homogenizer (SONIFIER 450, manufactured by BRANSON Co., Ltd.) with ice-cooling and stirring. Thus, the dispersion solution of spherical inorganic particles cl was prepared.

(3) Preparation of Spherical Organic High Polymer Particle Dispersion Solution

The dispersion solution of spherical organic high polymer particles (c2) was prepared according to the following prescription.

| | |
|---|---|
| XC99-A8808 (spherical crosslinkable polysiloxane particles, average particle size: 0.9 μm, manufactured by Toshiba Silicone Co., Ltd.) | 60 mass parts |
| Methyl ethyl ketone | 120 mass parts |
| Cyclohexanone (solid content: 20%, solvent: a 1/1 mixture of methyl ethyl ketone/cyclohexanone) | 120 mass parts |

These components were dispersed for 2 hours in an ultrasonic homogenizer (SONIFIER 450, manufactured by BRANSON Co., Ltd.) with ice-cooling and stirring, thereby the dispersion solution of spherical organic high polymer particles c2 was prepared.

(4) Preparation of Third Layer Coating Solution

The following components were added to 542 g of the above-described stock solution of sliding agent dispersion to thereby prepare a coating solution of the third layer.

| | |
|---|---|
| Diacetone alcohol | 5,950 g |
| Cyclohexanone | 176 g |
| Ethyl acetate | 1,700 g |
| The above dispersion solution of C Hosta KEP50 (c1) | 53.1 g |
| The above dispersion solution of spherical organic high polymer particles (c2) | 300 g |
| FC431 (solid content: 50%, solvent: ethyl acetate, manufactured by 3M Co., Ltd.) | 2.65 g |
| BYK 310 (solid content: 25%, manufactured by BYK Chemi Japan) | 5.3 g |

The above coating solution of :he third layer was coated on the second layer in a coating amount of 10.35 ml/m$^2$ and dried at 110° C., followed by further drying at 97° C. for 3 minutes.

[Light-sensitive Layer]

In the next place, each layer having the composition shown below was multilayer coated on the opposite side of the above-obtained backing layer, thereby a color negative film was prepared.

Composition of Light-sensitive Layer

The numeral corresponding to each component indicates the coated weight in unit of g/m$^2$, and the coated weight of silver halide is shown as the calculated weight of silver. (With respect to specific compounds in the following description, numerals are attached at the end of and chemical formulae are shown later.)

| | |
|---|---|
| First Layer: First Antihalation Layer | |
| Black Colloidal Silver | 0.070 as silver |
| Gelatin | 0.608 |
| ExM-1 | 0.035 |
| F-8 | 0.001 |
| HBS-1 | 0.050 |
| HBS-2 | 0.002 |
| Second Layer: Second Antihalation Layer | |
| Black Colloidal Silver | 0.089 as silver |
| Gelatin | 0.632 |
| ExF-1 | 0.002 |
| F-8 | 0.001 |
| Third Layer: Intermediate Layer | |
| Cpd-1 | 0.082 |
| HBS-1 | 0.043 |
| Gelatin | 0.422 |
| Fourth Layer: Low Sensitivity Red-Sensitive Emulsion Layer | |
| Em-D | 0.577 as silver |
| Em-C | 0.347 as silver |
| ExC-1 | 0.263 |
| ExC-2 | 0.015 |
| ExC-3 | 0.155 |
| ExC-4 | 0.144 |
| ExC-5 | 0.035 |
| ExC-6 | 0.015 |
| Cpd-4 | 0.025 |
| UV-2 | 0.047 |
| UV-3 | 0.086 |
| UV-4 | 0.018 |
| HBS-1 | 0.245 |
| HBS-5 | 0.038 |
| Gelatin | 0.994 |
| Fifth Layer: Middle Sensitivity Red-Sensitive Emulsion Layer | |
| Em-B | 0.431 as silver |
| Em-C | 0.432 as silver |
| ExC-1 | 0.110 |
| ExC-2 | 0.027 |
| ExC-3 | 0.007 |
| ExC-4 | 0.075 |
| ExC-5 | 0.007 |
| ExC-6 | 0.021 |
| ExC-8 | 0.010 |
| ExC-9 | 0.005 |
| Cpd-2 | 0.032 |
| Cpd-4 | 0.020 |
| HBS-1 | 0.098 |
| Gelatin | 0.802 |
| Sixth Layer: High Sensitivity Red-Sensitive Emulsion Layer | |
| Em-A | 1.214 as silver |
| ExC-1 | 0.070 |
| ExC-3 | 0.005 |
| ExC-6 | 0.026 |
| ExC-8 | 0.109 |
| ExC-9 | 0.020 |
| Cpd-2 | 0.068 |
| Cpd-4 | 0.020 |
| HBS-1 | 0.231 |
| Gelatin | 1.174 |
| Seventh Layer: Intermediate Layer | |
| Cpd-1 | 0.073 |
| Cpd-6 | 0.002 |

-continued

| | |
|---|---|
| HBS-1 | 0.037 |
| Polyethyl Acrylate Latex | 0.088 |
| Gelatin | 0.683 |
| Eighth Layer: Layer Giving Interlayer Effect to Red-Sensitive Layers | |
| Em-J | 0.153 as silver |
| Em-K | 0.153 as silver |
| ExM-2 | 0.086 |
| ExM-3 | 0.002 |
| ExM-4 | 0.025 |
| ExY-4 | 0.041 |
| ExC-7 | 0.026 |
| HBS-1 | 0.218 |
| HBS-3 | 0.003 |
| Gelatin | 0.649 |
| Ninth Layer: Low Sensitivity Green-Sensitive Emulsion Layer | |
| Em-H | 0.329 as silver |
| Em-G | 0.333 as silver |
| Em-I | 0.088 as silver |
| ExM-2 | 0.360 |
| ExM-3 | 0.055 |
| ExY-3 | 0.012 |
| ExC-7 | 0.008 |
| HBS-1 | 0.362 |
| HBS-3 | 0.010 |
| HBS-4 | 0.200 |
| Gelatin | 1.403 |
| Tenth Layer: Middle Sensitivity Green-Sensitive Emulsion Layer | |
| Em-F | 0.394 as silver |
| ExM-2 | 0.049 |
| ExM-3 | 0.034 |
| ExY-3 | 0.007 |
| ExC-7 | 0.012 |
| ExC-8 | 0.010 |
| HBS-1 | 0.060 |
| HBS-3 | 0.002 |
| HBS-4 | 0.020 |
| Gelatin | 0.474 |
| Eleventh Layer: High Sensitivity Green-Sensitive Emulsion Layer | |
| Em-E | 0.883 as silver |
| ExC-6 | 0.007 |
| ExC-8 | 0.011 |
| ExM-1 | 0.021 |
| ExM-2 | 0.092 |
| ExM-3 | 0.015 |
| Cpd-3 | 0.005 |
| Cpd-5 | 0.010 |
| HBS-1 | 0.176 |
| HBS-3 | 0.003 |
| HBS-4 | 0.070 |
| Polyethyl Acrylate Latex | 0.099 |
| Gelatin | 0.916 |
| Twelfth Layer: Yellow Filter Layer | |
| Cpd-1 | 0.092 |
| Solid Dispersion Dye ExF-2 | 0.088 |
| HBS-1 | 0.049 |
| Gelatin | 0.630 |
| Thirteenth Layer: Low Sensitivity Blue-Sensitive Emulsion Layer | |
| Em-O | 0.112 as silver |
| Em-M | 0.320 as silver |
| Em-N | 0.240 as silver |
| ExC-1 | 0.049 |
| ExC-7 | 0.013 |
| ExY-1 | 0.002 |
| ExY-2 | 0.693 |
| ExY-4 | 0.058 |
| HBS-1 | 0.231 |
| Gelatin | 1.553 |

-continued

| | |
|---|---|
| Fourteenth Layer: High Sensitivity Blue-Sensitive Emulsion Layer | |
| Em-L | 0.858 as silver |
| ExY-2 | 0.357 |
| ExY-4 | 0.068 |
| HBS-1 | 0.124 |
| Gelatin | 0.949 |
| Fifteenth Layer: First Protective Layer | |
| Silver Iodobromide Emulsion Having Particle Size of 0.07 μm | 0.245 as silver |
| UV-1 | 0.313 |
| UV-2 | 0.156 |
| UV-3 | 0.222 |
| UV-4 | 0.022 |
| F-18 | 0.007 |
| S-1 | 0.068 |
| HBS-1 | 0.175 |
| HBS-4 | 0.020 |
| Gelatin | 1.950 |
| Sixteenth Layer: Second Protective Layer | |
| H-1 | 0.356 |
| B-1 (diameter: 1.7 μm) | 0.050 |
| B-2 (diameter: 1.7 μm) | 0.150 |
| B-3 | 0.050 |
| S-1 | 0.200 |
| Gelatin | 0.675 |

Further, W-1 to W-6, B-4 to B-6, F-1 to F-17, lead salt, platinum salt, iridium salt and rhodium salt were appropriately added to each layer to improve storage stability, processing properties, pressure resistance, fungicidal and biocidal properties, antistatic properties and coating properties.

Preparation of Dispersion Product of Organic Solid Dispersion Dye

| | |
|---|---|
| ExF-2 in the eleventh layer was prepared as follows. Wet Cake of ExF-2 (containing 17.6 wt % of water) | 2.800 kg |
| Sodium Octylphenyl Diethoxymethanesulfonate (a 31 wt % aq. soln.) | 0.376 kg |
| F-15 (a 7% aq. soln.) | 0.011 kg |
| Water | 4.020 kg |
| Total (pH was adjusted to 7.2 with NaOH) | 7.210 kg |

The slurry having the above composition was stirred with a dissolver and coarsely dispersed, and then dispersed with an agitator mill LMK-4 at a peripheral speed of 10 m/s, discharge of 0.6 kg/min, and a packing rate of zirconia beads having a diameter of 0.3 mm of 80% until the absorbance ratio of the dispersion solution became 0.29, thereby a solid fine particle dispersion product was obtained. The average particle size of the fine particles of the dye was 0.29 μm.

TABLE 1

| Name of Emulsion | Average Iodide Content (mol %) | Equivalent-Sphere Diameter (μm) | Aspect Ratio | Equivalent-Circle Diameter (μm) | Thickness of Grain (μm) | Figure of Grain |
|---|---|---|---|---|---|---|
| Emulsion-A | 4 | 0.92 | 14 | 2 | 0.14 | tabular |
| Emulsion-B | 5 | 0.8 | 12 | 1.6 | 0.13 | tabular |
| Emulsion-C | 4.7 | 0.51 | 7 | 0.85 | 0.12 | tabular |
| Emulsion-D | 3.9 | 0.37 | 2.7 | 0.4 | 0.15 | tabular |
| Emulsion-E | 5 | 0.92 | 14 | 2 | 0.14 | tabular |
| Emulsion-F | 5.5 | 0.8 | 12 | 1.6 | 0.13 | tabular |
| Emulsion-G | 4.7 | 0.51 | 7 | 0.85 | 0.12 | tabular |
| Emulsion-H | 3.7 | 0.49 | 3.2 | 0.58 | 0.18 | tabular |
| Emulsion-I | 2.8 | 0.29 | 1.2 | 0.27 | 0.23 | tabular |
| Emulsion-J | 5 | 0.8 | 12 | 1.6 | 0.13 | tabular |
| Emulsion-K | 3.7 | 0.47 | 3 | 0.53 | 0.18 | tabular |
| Emulsion-L | 5.5 | 1.4 | 9.8 | 2.6 | 0.27 | tabular |
| Emulsion-M | 8.8 | 0.64 | 5.2 | 0.85 | 0.16 | tabular |
| Emulsion-N | 3.7 | 0.37 | 4.6 | 0.55 | 0.12 | tabular |
| Emulsion-O | 1.8 | 0.19 | — | — | — | cubic |

In Table 1, Emulsions A, B and C were optimally gold-sensitized, sulfur-sensitized and selenium-sensitized with an optimal amount of Spectral Sensitizing Dyes 1, 2 and 3. Emulsions E, F and G were optimally gold-sensitized, sulfur-sensitized and selenium-sensitized with an optimal amount of Spectral Sensitizing Dyes 4, 5 and 6. Emulsion J was optimally gold-sensitized, sulfur-sensitized and selenium-sensitized with an optimal amount of Spectral Sensitizing Dyes 7 and 8. Emulsion L was optimally gold-sensitized, sulfur-sensitized and selenium-sensitized with an optimal amount of Spectral Sensitizing Dyes 9, 10 and 11. Emulsion O was optimally gold-sensitized and sulfur-sensitized with an optimal amount of Spectral Sensitizing Dyes 10, 11 and 12. Emulsions D, H, I, K, M and N were optimally gold-sensitized, sulfur-sensitized and selenium-sensitized with an optimal amount of spectral sensitizing dyes shown in Table 2 below.

TABLE 2

| Name of Emulsion | Sensitizing Dye | Addition Amount (mol/mol Ag) |
|---|---|---|
| Em-D | Sensitizing Dye 1 | $5.44 \times 10^{-4}$ |
| | Sensitizing Dye 2 | $2.35 \times 10^{-4}$ |
| | Sensitizing Dye 3 | $7.26 \times 10^{-6}$ |
| Em-H | Sensitizing Dye 8 | $6.52 \times 10^{-4}$ |
| | Sensitizing Dye 13 | $1.35 \times 10^{-4}$ |
| | Sensitizing Dye 6 | $2.48 \times 10^{-5}$ |
| Em-I | Sensitizing Dye 8 | $6.09 \times 10^{-4}$ |
| | Sensitizing Dye 13 | $1.26 \times 10^{-4}$ |
| | Sensitizing Dye 6 | $2.32 \times 10^{-5}$ |
| Em-K | Sensitizing Dye 7 | $6.27 \times 10^{-4}$ |
| | Sensitizing Dye 8 | $2.24 \times 10^{-4}$ |
| Em-M | Sensitizing Dye 9 | $2.43 \times 10^{-4}$ |
| | Sensitizing Dye 10 | $2.43 \times 10^{-4}$ |
| | Sensitizing Dye 11 | $2.43 \times 10^{-4}$ |
| Em-N | Sensitizing Dye 9 | $3.28 \times 10^{-4}$ |
| | Sensitizing Dye 10 | $3.28 \times 10^{-4}$ |
| | Sensitizing Dye 11 | $3.28 \times 10^{-4}$ |

The sensitizing dyes in Table 2 are shown below.

Sensitizing Dye 1

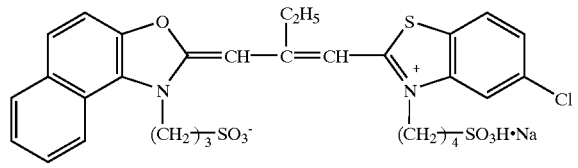

Sensitizing Dye 2

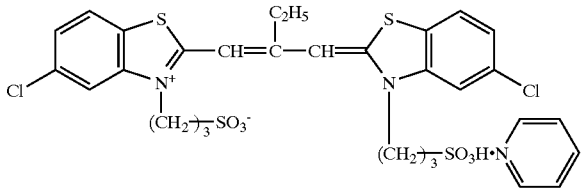

Sensitizing Dye 3

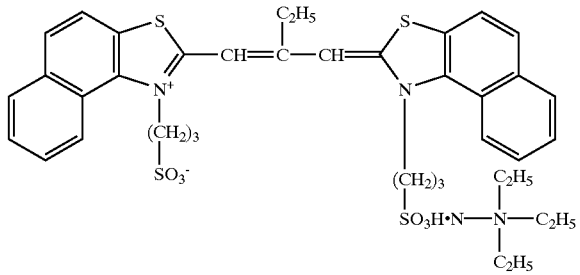

Sensitizing Dye 4

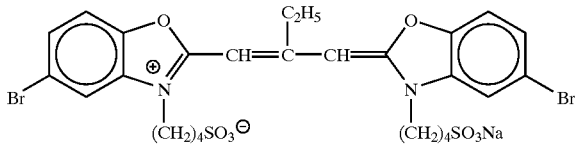

Sensitizing Dye 5

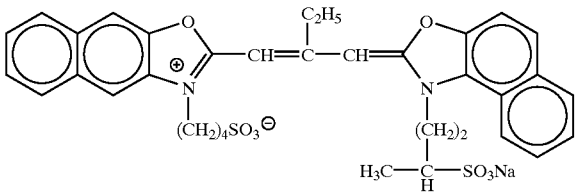

Sensitizing Dye 6

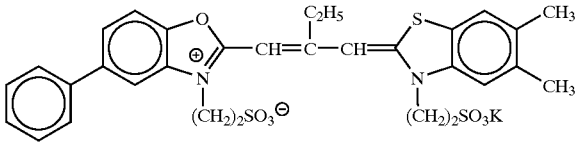

Sensitizing Dye 7

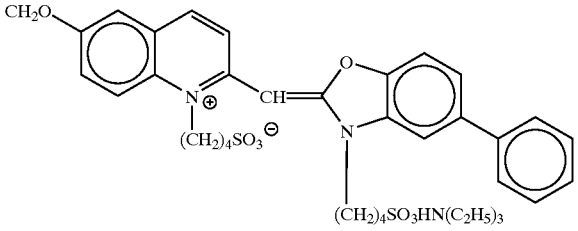

Sensitizing Dye 8

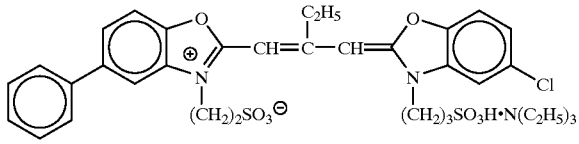

Sensitizing Dye 9

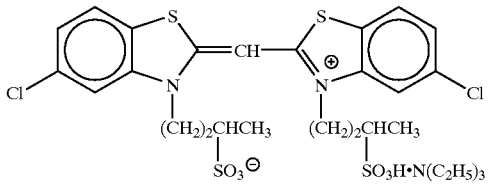

Sensitizing Dye 10

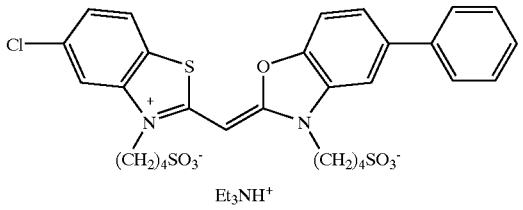

Sensitizing Dye 11

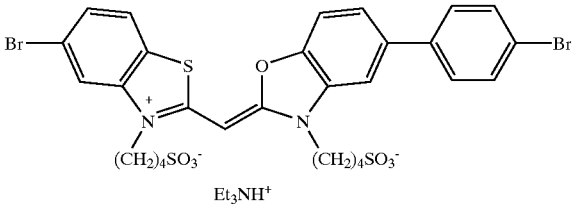

Sensitizing Dye 12

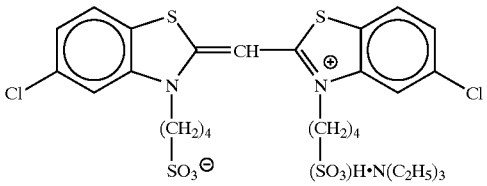

Sensitizing Dye 13

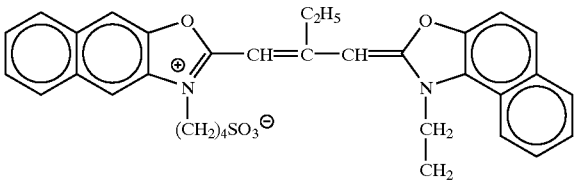

Low molecular weight gelatin was used for preparing the tabular grains according to the example in JF-A-l-158426.

Emulsions A to K contain an optimal amount of Ir and Fe.

Emulsions L, M, N and O were reduction-sensitized in preparing grains.

Dislocation lines as disclosed in JP-A-3-237450 are observed in the tabular grains with a high pressure electron microscope.

Dislocation lines were introduced into Emulsions A, B, C and J by using an iodine ion-releasing agent according to the method disclosed in the example in JP-A-6-11782.

Dislocation lines were introduced into Emulsion E by using silver iodide fine grains prepared just before addition in a different chamber equipped with a magnetic coupling induction stirrer as disclosed in JP-A-10-43570.

Various compounds used in each layer are shown below.

ExC-1
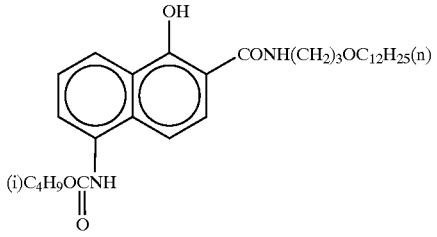
ExC-2
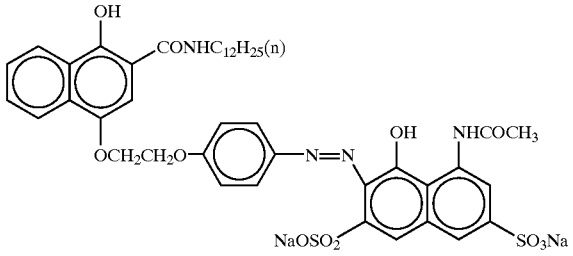
ExC-3
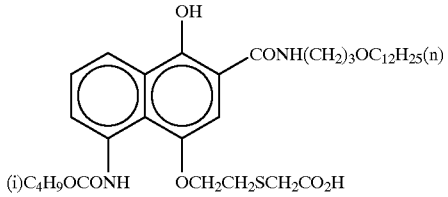
ExC-4
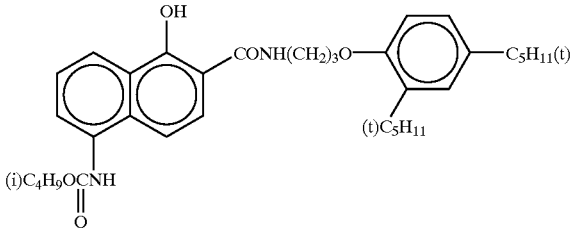
ExC-5
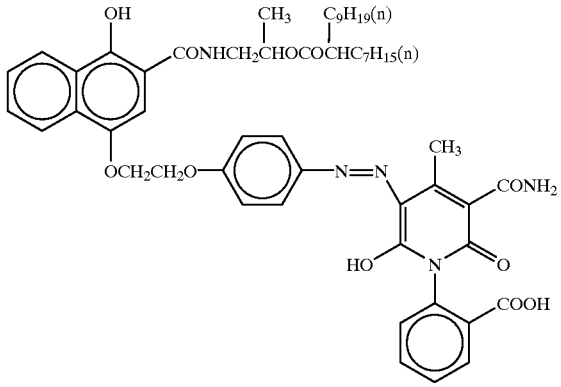
ExC-6
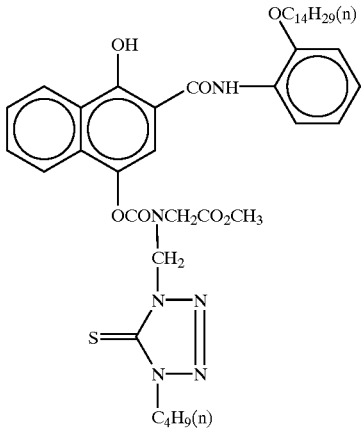
ExC-7
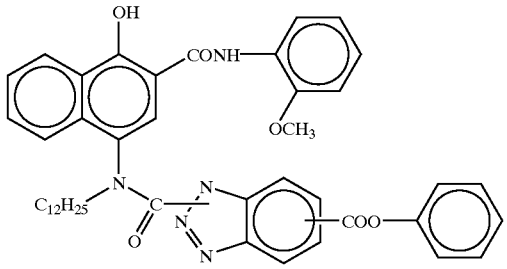
ExC-8
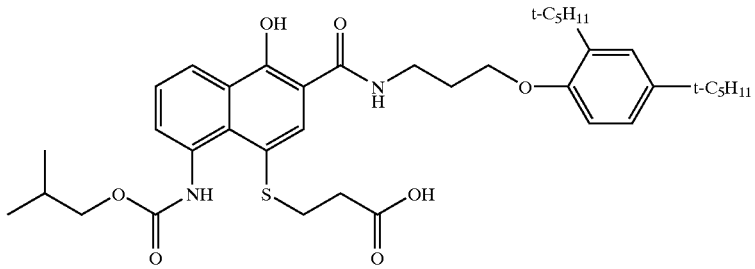

-continued
ExC-9
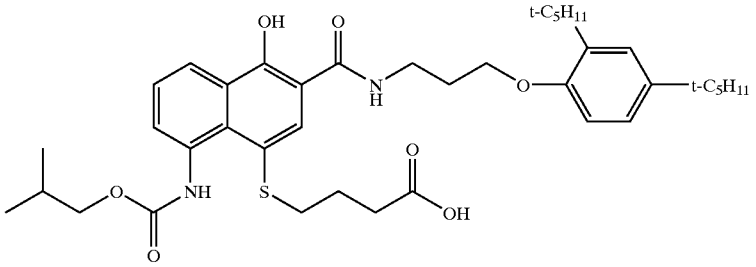
ExM-1
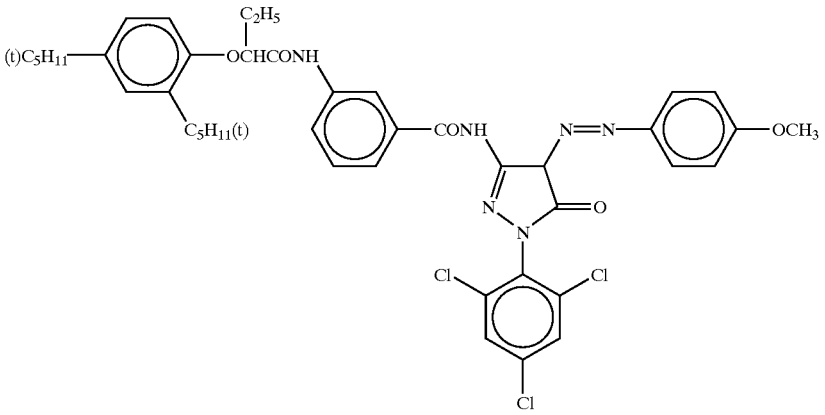
ExM-2
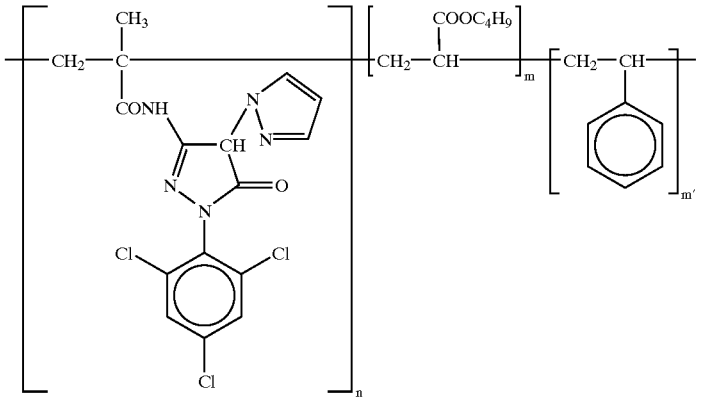
$n$ = 50
$m$ = 25
$m'$ = 25
mol. wt.: about 20,000
ExM-3
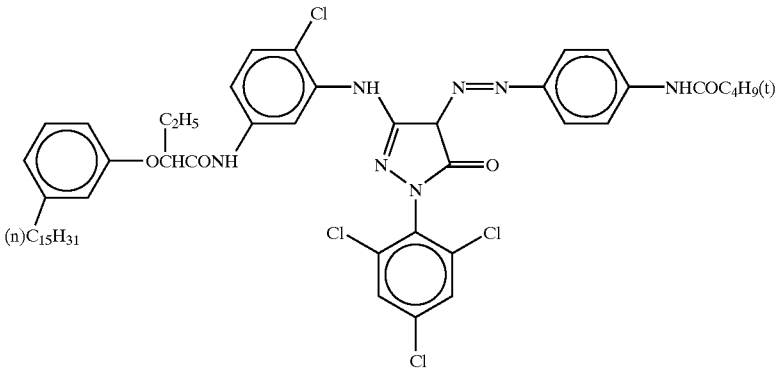

-continued
ExM-4
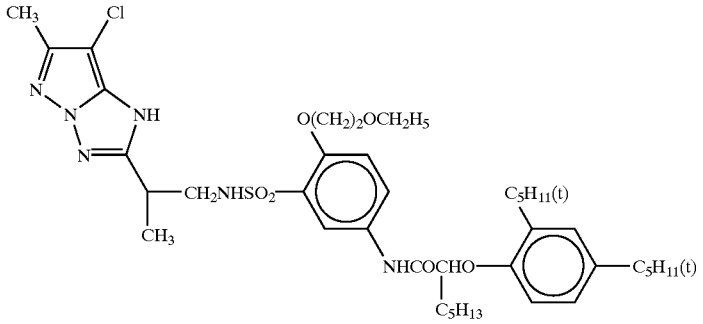
ExY-1
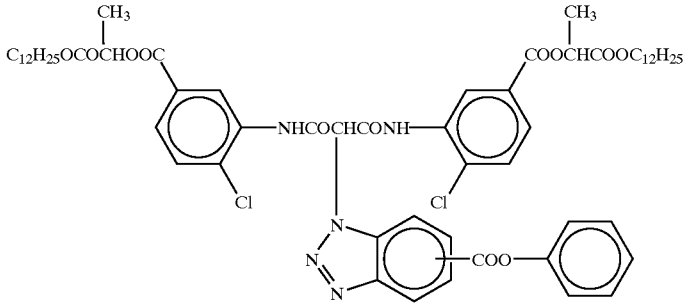
ExY-2
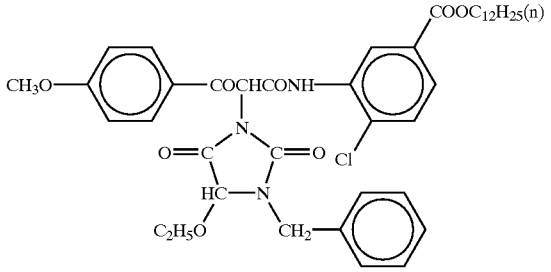
ExY-3
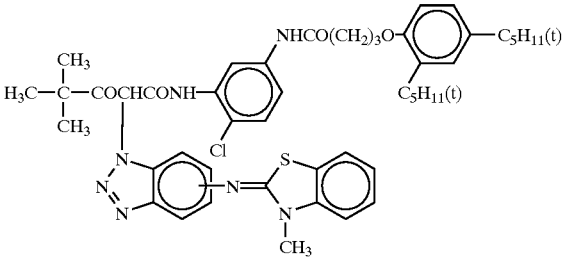
ExY-4
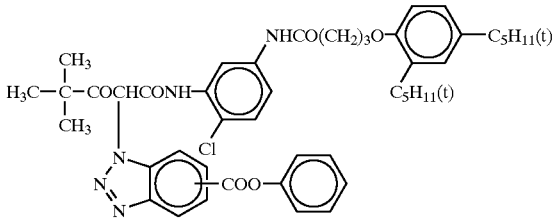
Cpd-1
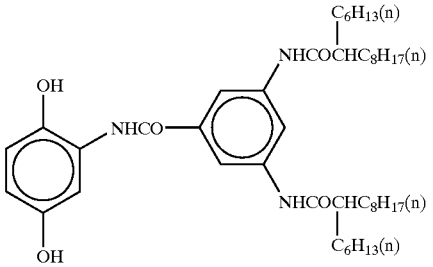
Cpd-2
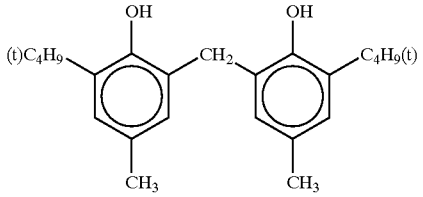
Cpd-3
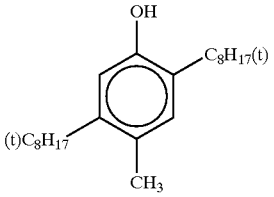
Cpd-4
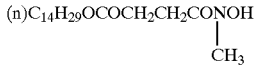
Cpd-5
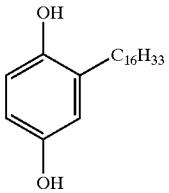

-continued
(=====)
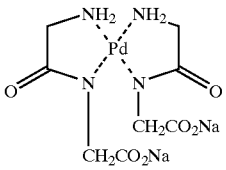
Cpd-6
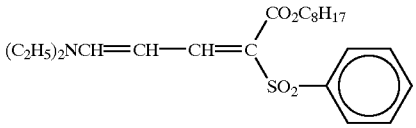
UV-1
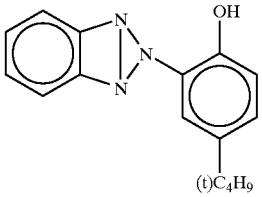
UV-2
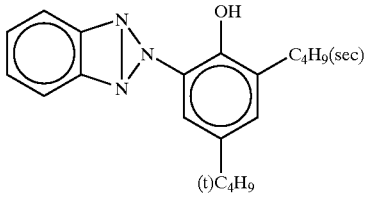
UV-3
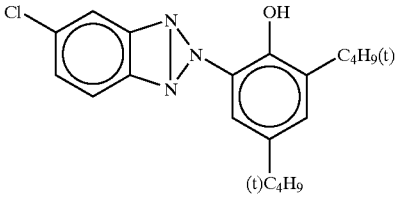
UV-4
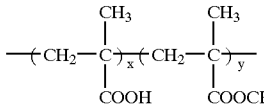
x/y = 10/90 (mass ratio)
av. mol. wt. : about 35,000
B-1
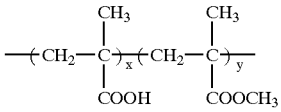
x/y = 40/60 (mass ratio)
av. mol. wt. : about 20,000
B-2
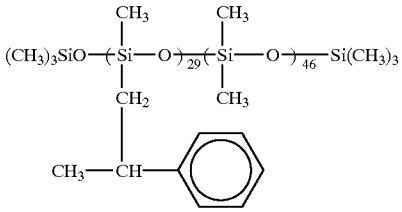
(molar ratio)
av. mol. wt. : about 8,000
B-3
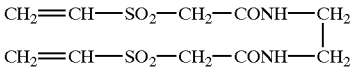
Di-n-butyl Phthalate
H-1
Tricresyl Phosphate
HBS-1
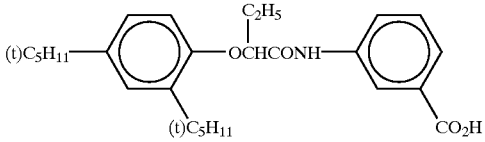
HBS-2
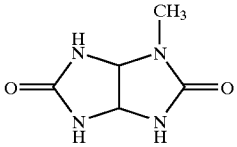
Tri(n-ethylhexyl)phosphate
HBS-3
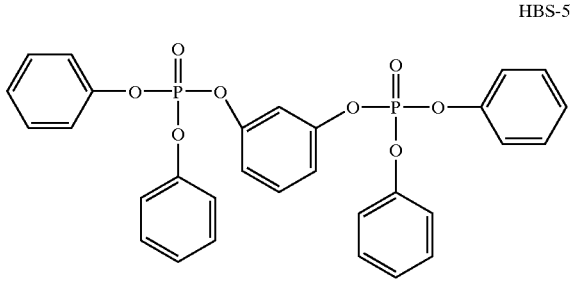
HBS-4
HBS-5
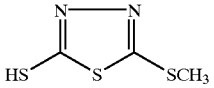
S-1
F-1

-continued
F-2
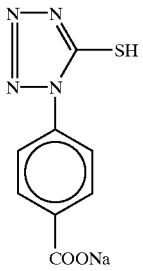
F-3
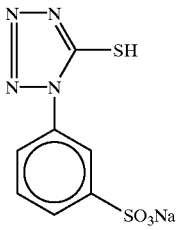
F-4
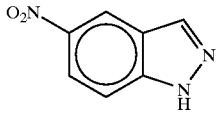
F-5
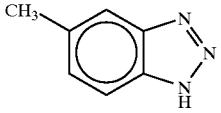
F-6
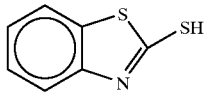
F-7
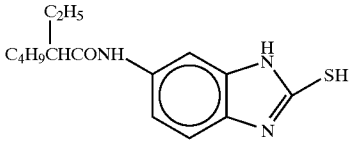
F-8
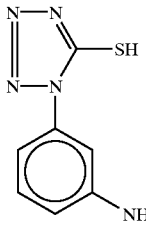
W-1
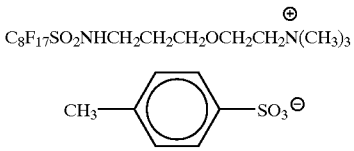
W-2
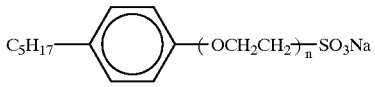
n=2~4
W-3
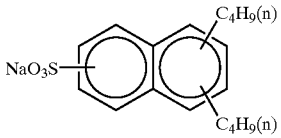
W-4
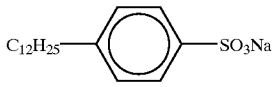
W-5
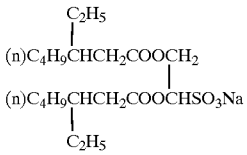
W-6
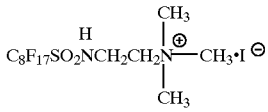
B-4
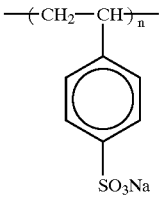
av. mol. wt.: about 750,000
B-5
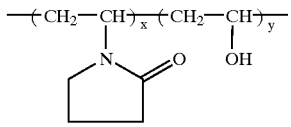
x/y = 70/30 (mass ratio)
av. mol. wt.: about 17,000
B-6
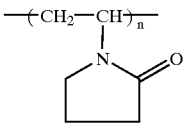
av. mol. wt.: about 10,000

-continued

ExF-1

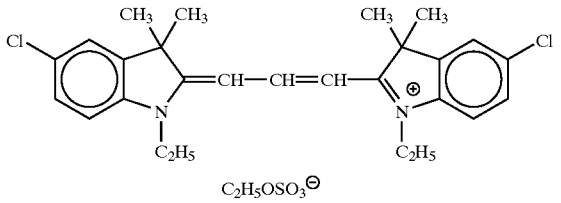

ExF-2

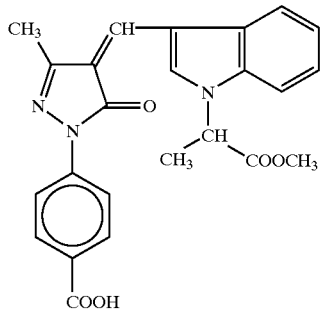

2. Test Method of Photographic Characteristics

Each of the above-prepared samples was subjected to exposure for sensitometry according to the method described in International Standard ISO5800 (a method for measuring sensitivity of a color negative film) through a standard C light source and a neutral color continuous wedge (density gradient: 0.4 ΔD/cm, density range: 0.02 to 4.8). This exposed sample was used in the following development processing and photographic characteristics (sensitivity, gradation and fog) were found.

3. Development Processing

Development processing was performed by means of the following development processor for color negative film and the prescription.

As the processor, the processing time of automatic processor FP-363SC (manufactured by Fuji Photo Film Co., Ltd.) was modified to make an experiment processor. The processor is provided with replenishing mechanism of automatic stopper opening and automatic preparation system. The outline of the processor is described below. Plastic (HDPE) bottles described above are installed side by side with the opening down. After the mixing bottle is capped, the bottle moves downward from the upside toward the opening punch nozzle which is installed in the processor with the tip upward so that the opening punch nozzle sticks in the cap to thrust the cap of the bottle through, to thereby the content of the bottle is injected into a replenisher tank. Thereafter, a prescribed amount of washing water jets out from the nozzle hole of the punch nozzle and the inside of the bottle is washed. The water used for washing is introduced to the replenisher tank and used as a dilution water to prepare a replenisher. Accordingly, the processing agent filled in the bottle is diluted with washing water and the like to prepare a replenisher automatically.

The processing step and the composition of each processing solution are shown below.

| Processing Step | | | | |
|---|---|---|---|---|
| Step | Processing Time | Processing Temperature (° C.) | Replenishing Rate+ (ml) | Tank Capacity (liter) |
| Color Development | 3 min 05 sec | 41.0 | 15 | 10.3 |
| Bleaching | 50 sec | 40.0 | 5 | 3.6 |

-continued

| Processing Step | | | | |
|---|---|---|---|---|
| Step | Processing Time | Processing Temperature (° C.) | Replenishing Rate+ (ml) | Tank Capacity (liter) |
| Fixing (1) | 50 sec | 40.0 | — | 3.6 |
| Fixing (2) | 50 sec | 40.0 | 7.5 | 3.6 |
| Rinsing (1) | 30 sec | 40.0 | — | 1.9 |
| Rinsing (2) | 20 sec | 40.0 | — | 1.9 |
| Rinsing (3) | 20 sec | 40.0 | 15 | 1.9 |
| Drying | 90 sec | 60.0 | — | |

*Replenishing rate: per 1.1 meter of 35 mm wide photographic material (corresponding to a 24 Ex. Film)

Rinsing solutions are connected in a countercurrent system from (3) to (2) to (1). Fixing tanks are also connected by countercurrent piping from (2) to (1). The tank solution of rinsing tank (2) is introduced into fixing tank (2) in an amount of 15 ml corresponding to the replenishing amount. Further, the amount of the carryover of the developing solution into the bleaching step, the amount of the carryover of the bleaching solution to the fixing step, and the amount of the carryover of the fixing solution to the rinsing step are each 2.0 ml per 1.1 meter of 35 mm wide photographic material. Further, the crossover time is 6 seconds in each case, and this time is included in the processing time of he previous step.

The composition of each processing solution is described below.

| | Tank Solution | Replenisher |
|---|---|---|
| Color Developing Solution 26 | | |
| Diethylenetriaminepentaacetic Acid | 2.0 g | 4.0 g |
| Sodium 4,5-Dihydroxybenzene-1,3-disulfonate | 0.4 g | 0.5 g |
| Disodium-N,N-bis(sulfonatoethyl)-hydroxylamine | 10.0 g | 15.0 g |
| Sodium Sulfite | 4.0 g | 9.0 g |
| Potassium Bromide | 1.4 g | — |
| 4-Amino-3-methyl-N-ethyl-N-(β-hydroxyethyl)aniline Sulfate | (shown in Table 3) | (shown in Table 3) |
| Potassium Carbonate | 39 g | 59 g |
| Compound represented by Formula (I) | (shown in Table 3) | (shown in Table 3) |

-continued

| | Tank Solution | Replenisher |
|---|---|---|
| Glycols | (shown in Table 3) | (shown in Table 3) |
| Polyethylene Glycol | (shown in Table 3) | (shown in Table 3) |
| Hydroxylamine Sulfate | 2.0 g | 4.0 g |
| Water to make | 1.0 liter | 1.0 liter |
| pH (adjusted with sulfuric acid and KOH) | 10.07 | 10.51 |
| Beaching Solution | | |
| Ammonium 1,3-Diaminopropanetetra-acetato Ferrate Monohydrate | 120 g | 180 g |
| Ammonium Bromide | 50 g | 70 g |
| Succinic Acid | 30 g | 50 g |
| Maleic Acid | 40 g | 60 g |
| Imidazole | 20 g | 30 g |
| Water to make | 1.0 liter | 1.0 liter |
| pH (adjusted with aqueous ammonia and nitric acid) | 4.6 | 4.0 |
| Fixing Solution | | |
| Ammonium Thiosulfate (750 g/liter) | 280 ml | 750 ml |
| Ammonium Bisulfite Aqueous Solution (72%) | 20 g | 80 g |
| Imidazole | 5 g | 45 g |
| 1-Mercapto-2-(N,N-dimethylamino-ethyl) tetrazole | 1 g | 3 g |
| Ethylenediaminetetraacetic Acid | 8 g | 12 g |
| Water to make | 1 liter | 1 liter |
| pH (adjusted with aqueous ammonia and nitric acid) | 7.0 | 7.0 |
| Rinsing Solution (replenisher equals tank solution) | | |
| Sodium p-Toluenesulfinate | 0.03 g | |
| p-Nonylphenoxypolyglycidol (average polymerization degree of glycidol: 10) | 0.4 g | |
| Disodium Ethylenediaminetetraacetate | 0.05 g | |
| 1,2,4-Triazole | 1.3 g | |
| 1,4-Bis (1,2,4-triazol-1-ylmethyl)-piperazine | 0.75 g | |
| 1,2-Benzisothiazolin-3-one | 0.10 g | |
| Water to make | 1.0 liter | |
| pH | 8.5 | |

4. Test and Test Results

A two and a half time concentrate of the color developing replenisher prescription described in the development processing described in the above item 3, was prepared. ("Concentration" in a liquid processing agent is terminology meaning the ratio to the value in the processing prescription of the concentration of the processing agent composition and not means the concentration due to evaporation and the like.) A fixed amount of the concentrated developing replenisher composition was poured into liquid-mixing plastic bottles (HDPE) or processing agents and aged at 50° C., 70% RH for 5 weeks. The bottles were installed at the replenisher-preparing part of the above modified processor, and the concentrated developing replenisher composition was discharged from each plastic bottle to a replenisher tank according to the above-described method, diluted with washing water, thus a replenisher was prepared in each replenisher tank. The above tank solution prepared separately was poured into the processor, and 30% exposed film of the above sample film was processed with replenishing from the replenisher tank (30% exposure was due to the fact that the sensitivity rate of the silver halide grains is 30% under average photographing condition of color negative films). When the amount of the used developing replenisher reached 1.0 time of the developing tank capacity, the piece of the above sample film exposed through photo-wedge exposure for sensitometry was subjected to development processing and the photographic property obtained was compared with the photographic property obtained by standard processing shown below. The processing step and the composition of the processing solution of standard processing are shown below. Except color developing solution, processing solutions having he same compositions as above were used in processing.

Processing Step

| Step | Processing Time | Processing Temperature (° C.) | Replenishing Rate+ (ml) | Tank Capacity (liter) |
|---|---|---|---|---|
| Color Development | 3 min 05 sec | 38.0 | 15 | 10.3 |
| Bleaching | 50 sec | 38 | 5 | 3.6 |

TABLE 3

| Standard | Compound (I) | Amount Added (g/liter) | Glycol | Amount Added (g/liter) | PEG | Amount Added (g/liter) | Conc. of Developing Agent (g/liter) | Remarks |
|---|---|---|---|---|---|---|---|---|
| 1 | — | — | DEG | 20 | 2,000 | 2 | 8 | Comparison |
| 2 | I-20 | 2 | — | — | 2,000 | 2 | 8 | Comparison |
| 3 | I-20 | 2 | DEG | 20 | — | — | 8 | Comparison |
| 4 | I-20 | 2 | DEG | 20 | 2,000 | 2 | 8 | Invention |
| 5 | I-20 | 2 | DEG | 20 | 2,000 | 2 | 6 | Invention |
| 6 | I-20 | 2 | DEG | 20 | 2,000 | 2 | 16 | Invention |
| 7 | I-20 | 2 | DEG | 5 | 2,000 | 2 | 8 | Invention |
| 8 | I-20 | 2 | DEG | 20 | 2,000 | 1 | 8 | Invention |
| 9 | I-20 | 1 | DEG | 20 | 2,000 | 2 | 8 | Invention |
| 10 | I-20 | 2 | DEG | 20 | 1,500 | 2 | 8 | Invention |
| 11 | I-20 | 2 | DEG | 20 | 1,000 | 2 | 8 | Invention |
| 12 | I-20 | 2 | TEG | 20 | 1,000 | 2 | 8 | Invention |
| 13 | I-1 | 2 | DEG | 20 | 2,000 | 2 | 8 | Invention |
| 14 | I-13 | 2 | DEG | 20 | 2,000 | 2 | 8 | Invention |
| 15 | I-23 | 2 | DEG | 20 | 2,000 | 2 | 8 | Invention |
| 16 | I-30 | 2 | DEG | 20 | 2,000 | 2 | 8 | Invention |

-continued

| Processing Step | | | | |
|---|---|---|---|---|
| Step | Processing Time | Processing Temperature (° C.) | Replenishing Rate* (ml) | Tank Capacity (liter) |
| Fixing (1) | 50 sec | 38 | — | 3.6 |
| Fixing (2) | 50 sec | 38 | 7.5 | 3.6 |
| Stabilization (1) | 30 sec | 38 | — | 1.9 |
| Stabilization (2) | 20 sec | 38 | — | 1.9 |
| Stabilization (3) | 20 sec | 38 | 30 | 1.9 |
| Drying | 1 min 30 sec | 60 | | |

*Replenishing rate: per 1.1 meter of 35 wide photographic material (corresponding to a 24 Ex. film)

Stabilization solutions are connected in a countercurrent system from (3) to (2) to (1). Fixing tanks are also connected by countercurrent piping from (2) to (1). The tank solution of stabilization tank (2) is introduced into fixing tank (2) in an amount of 15 ml corresponding to the replenishing amount. Further, the amount of the carryover of the developing solution into the bleaching step, the amount of the carryover of the bleaching solution to the fixing step, and he amount of the carryover of the fixing solution to the rinsing step are each 2.0 ml per 1.1 meter of 35 mm wide photographic material. Further, the crossover time is 6 seconds in each case, and this time is included in the processing time of the previous step.

The composition of the processing solution is described below.

| Color Developing Solution | | |
|---|---|---|
| | Tank Solution | Replenisher |
| Diethylenetriaminepentaacetic Acid | 2.0 g | 4.0 g |
| Sodium 4,5-Dihydroxybenzene-1,3-disulfonate | 0.4 g | 0.5 g |
| Disodium-N,N-bis(sulfonatoethyl)-hydroxylamine | 10.0 g | 15.0 g |
| Sodium Sulfite | 4.0 g | 9.0 g |
| Potassium Bromide | 1.4 g | — |
| Diethylene Glycol | 10.0 g | 17.0 g |
| Ethyleneurea | 3.0 g | 5.5 g |
| 4-Amino-3-methyl-N-ethyl-N-(β-hydroxyethyl) aniline Sulfate | 4.7 g | 11.4 g |
| Potassium Carbonate | 39 g | 59 g |
| Hydroxylamine Sulfate | 2.0 g | 4.0 g |
| Water to make | 1.0 liter | 1.0 liter |
| pH (adjusted with sulfuric acid and KOH) | 10.07 | 10.51 |

Evaluation of Photographic Property

Photographic property was compared as follows. That is, photographic property is indicated by the color balance difference obtained from the transmission density at the prescribed exposure amount measured of the sample piece after being processed (the piece of the sample film exposed through photo-wedge exposure for sensitometry) as follows. Color balance difference: Δ(R-G)=[(R density at test processing)−(G density at test processing)]−[(R density at standard processing)−(G density at standard processing)]

Each R density and G density are the densities at logarithmic exposure amount (logE) of 3.0 (anti-logarithmic value of the exposure amount is 1,000 cms).

The nearer to 0 is the color balance difference, it means that the color balance by test processing is finished equal to the color balance by standard processing. The results obtained are shown in Table 4.

Resistance to Coloring of Container

After the above plastic bottles (HDPE) filled with each processing agent composition had been aged for 4 weeks at 50° C., 70% RH, emptied out the processing agent composition from each bottle, and the coloring state of the empty bottle was visually evaluated according to criteria for judging of o: showing no coloring, _: slight coloring was observed but was in an allowable range, and x: coloring of not allowable level was observed.

Stability of Concentrated Composition

After the above plastic bottles (HDPE) filled with each processing agent composition had been aged for 4 weeks at 0° C., emptied out the processing agent composition from each bottle, and the presence of precipitation at the bottom of the empty bottle and the state of turbidity of the composition taken out were visually observed and evaluated according to criteria for judging of o: neither turbidity nor precipitation was observed, _: a slight: degree of turbidity was observed and precipitation was not observed or allowable, if any, and x: turbidity and precipitation of not allowable level were observed.

The results obtained are shown in Table 4.

TABLE 4

| Standard | Coloring of Container | Precipitation | Color Balance Δ(R-G) | Remarks |
|---|---|---|---|---|
| 1 | x | ○ | −0.15 | Comparison |
| 2 | _ | X | −0.35 | Comparison |
| 3 | _ | _ | −0.34 | Comparison |
| 4 | o | ○ | −0.04 | Invention |
| 5 | o | ○ | −0.06 | Invention |
| 6 | o | ○ | −0.15 | Invention |
| 7 | o | ○ | −0.12 | Invention |
| 8 | o | ○ | −0.13 | Invention |
| 9 | o | ○ | −0.13 | Invention |
| 10 | o | ○ | −0.15 | Invention |
| 11 | o | ○ | −0.16 | Invention |
| 12 | o | ○ | −0.14 | Invention |
| 13 | o | ○ | −0.08 | Invention |
| 14 | o | ○ | −0.09 | Invention |
| 15 | o | ○ | −0.10 | Invention |
| 16 | o | ○ | −0.11 | Invention |

As apparently seen from the results in Table 4, in the comparative samples (standards 1, 2 and 3) in which any of the compound represented by formula (I), glycol and polyethylene glycol was not contained, all of the photographic characteristics represented by resistance to coloring of container, resistance to turbidity and precipitation, and color balance were not satisfied, in particular, poor in resistance to coloring of container. Contrary to this, in the samples according to the present invention (standards 4 to 16) which contained everything of the compound represented by formula (I), glycol and polyethylene glycol, all of the photographic characteristics represented by resistance to coloring of container, resistance to turbidity and precipitation, and color balance showed satisfactory results.

A liquid processing agent composition for color development of a silver halide color photographic material according to the present invention, which contains 4,4'-bis(2,6-diaminotriazin-4-ylamino)stilbene of specific structure having at least four sulfonic acid groups in the molecule, at least one glycol selected from ethylene glycol, diethylene glycol and triethylene glycol, and at least one polyethylene glycol (having a number average molecular weight of from 1,000 to 2,000), has sufficient solubility not causing turbidity and precipitation during storage of the processing agent, is resistant to coloring of container ever when it is used as a highly concentrated liquid composition, and has rapid development aptitude capable of maintaining color balance even by high temperature and rapid development. By using this processing agent composition, it becomes possible to realize a development processing method of a silver halide color photographic material even by rapid and/or high temperature processing within 2 minutes and 30 seconds and/or processing temperature of 40° C. or higher without reducing photographic characteristics.

The entire disclosure of each and every foreign patent application from which the benefit of foreign priority has been claimed in the present application is incorporated herein by reference, as if fully set forth.

What is claimed is:

1. A liquid processing composition for a color development of a silver halide color photographic material, which comprises:

at least one compound represented by the following formula (I);

at least one glycol selected from the group consisting of ethylene glycol, diethylene glycol and triethylene glycol; and at least one polyethylene glycol having a number average molecular weight of from 1,000 to 2,000:

(I)

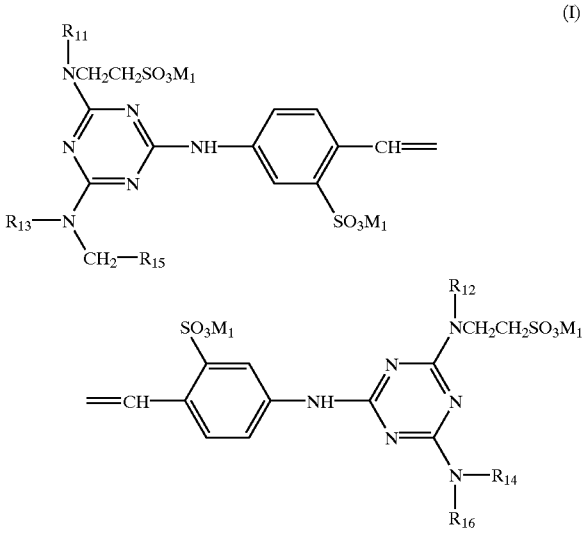

wherein $R_{11}$ and $R_{12}$ each independently represents a hydrogen atom or an alkyl group; $R_{13}$ and $R_{14}$ each independently represents a hydrogen atom, an alkyl group or an aryl group; $R_{15}$ represents an alkyl group having at least one asymmetric carbon atom, or a group represented by the following formula (I-a); $R_{16}$ represents an alkyl group having at least one asymmetric carbon atom, or a group represented by the following formula (I-b); and $M_1$ represents a hydrogen atom, an alkali metal atom, an alkaline earth metal atom, an ammonium croup or a pyridinium group; $R_{13}$ and $R_{15}$ and $R_{14}$ and $R_{16}$ may be bonded to each other to form a ring;

$$—CH_2O(CH_2CH_2O)_{n_{11}}H \quad \text{(I-a)}$$

wherein $n_{11}$ represents an integer of from 1 to 3;

$$—(CH_2CH_2O)_{n_{12}}H \quad \text{(I-b)}$$

wherein $n_{12}$ represents an integer of from 2 to 4.

2. The liquid processing composition for a color development of a silver halide color photographic material as claimed in claim 1, wherein in formula (I), at least one of $R_{15}$ and $R_{16}$ includes a hydroxyl group.

3. The liquid processing composition or a color development of a silver halide color photographic material as claimed in claim 1, wherein in formula (I), $R_{11}$, $R_{12}$, $R_{13}$ and $R_{14}$ each independently represents a hydrogen atom or a methyl group, $R_{15}$ is a group represented by formula 2), 5) or 11) below, or a group represented by formula (I-a) wherein $n_{11}$ is 1, $R_{16}$ is a group represented by formula 17), 20) or 26) below, or a group represented by formula (I-b) wherein $n_{12}$ is 2, $M_1$ is Na or K:

2)

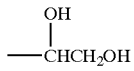

5)

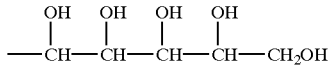

11)

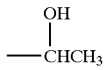

17)

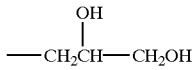

20)

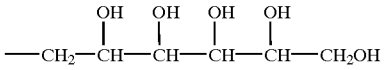

26)

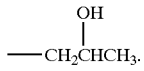

4. The liquid processing composition for a color development of a silver halide color photographic material as claimed in claim 1, wherein the at least one glycol is selected from the group consisting of diethylene glycol and triethylene glycol.

5. The liquid processing composition for a color development of a silver halide color photographic material as claimed in claim 1, which.comprises the compound represented by the formula (I) in an amount of from 1 to 50 g/liter of the amount of the composition.

6. The liquid processing composition for a color development of a silver halide color photographic material as claimed in claim 1, which comprises the glycol in an amount of from 5 to 100 g/liter of the amount of the composition.

7. The liquid processing composition for a color development of a silver halide color photographic material as claimed in claim 1, which comprises the polyethylene glycol in an amount of from 1 to 20 g/liter of the amount of the composition.

8. The liquid processing composition for a color development of a silver halide color photographic material as claimed in claim 1, which comprises 4-amino-3-methyl-N-ethyl-N-(β-hydroxyethyl)aniline or a salt thereof as a color developing agent in an amount of from 15 to 50 g/liter of the amount of the composition.

9. A method for processing a silver halide color photographic material, which comprises performing a color development processing within 2 minutes and 30 seconds with the liquid processing composition for a color development as described in claim 1, wherein the liquid processing composition for a color development is used as it is or by being diluted, as a color developing replenisher or a color developer.

10. The method for processing a silver halide color photographic material as claimed in claim 9, wherein the liquid processing composition for a color development has a concentration of from 1.5 to 10 times as high as that of the solution in working state.

11. The method for processing a silver halide color photographic material as claimed in claim 9, wherein the silver halide color photographic material is a color photographic material for photographing.

12. The method for processing a silver halide color photographic material as claimed in claim 9, wherein the color photographic material for photographing is a color negative photographic material for photographing.

13. A method for processing a silver halide color photographic material, which comprises performing a color development processing at processing temperature of 40° C. or higher with the liquid processing composition for a color development as described in claim 1, wherein the liquid processing composition for a color development is used as it is or by being diluted, as a color developing replenisher or a color developer.

14. The method for processing a silver halide color photographic material as claimed in claim 13, wherein the liquid processing composition for a color development has a concentration of from 1.5 to 10 times as high as that of the solution in working state.

15. The method for processing a silver halide color photographic material as claimed in claim 13, wherein the silver halide color photographic material is a color photographic material for photographing.

16. The method for processing a silver halide color photographic material as claimed in claim 13, wherein the color photographic material for photographing is a color negative photographic material for photographing.

* * * * *